US010282941B2

(12) United States Patent
Ward et al.

(10) Patent No.: US 10,282,941 B2
(45) Date of Patent: May 7, 2019

(54) CASHING OUT INDEPENDENT WAGERING GAMES

(71) Applicant: WMS Gaming, Inc., Waukegan, IL (US)

(72) Inventors: Matthew J. Ward, Northbrook, IL (US); John McCormack, Gainesville, FL (US); Joseph A. Sharpe, Las Vegas, NV (US); Craig J. Sylla, Round Lake, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 953 days.

(21) Appl. No.: 14/684,950

(22) Filed: Apr. 13, 2015

(65) Prior Publication Data

US 2015/0302695 A1 Oct. 22, 2015

Related U.S. Application Data

(60) Provisional application No. 61/980,402, filed on Apr. 16, 2014.

(51) Int. Cl.
*G07F 17/32* (2006.01)

(52) U.S. Cl.
CPC ..... *G07F 17/3244* (2013.01)

(58) Field of Classification Search
CPC ..... G07F 17/3244
See application file for complete search history.

(56) References Cited

U.S. PATENT DOCUMENTS

| | | | |
|---|---|---|---|
| 5,259,613 | A | 11/1993 | Marnell, II |
| 5,265,874 | A | 11/1993 | Dickinson et al. |
| 5,326,104 | A | 7/1994 | Pease et al. |
| 5,342,047 | A | 8/1994 | Heidel et al. |
| 5,412,404 | A | 5/1995 | Candy |
| 5,450,938 | A | 9/1995 | Rademacher |
| 5,605,506 | A | 2/1997 | Hoorn et al. |
| 5,655,961 | A | 8/1997 | Acres et al. |
| 5,919,091 | A | 7/1999 | Bell et al. |

(Continued)

FOREIGN PATENT DOCUMENTS

| | | |
|---|---|---|
| AU | 199534536 | 5/1998 |
| WO | 9712315 | 4/1997 |
| WO | 2007146346 | 12/2007 |

OTHER PUBLICATIONS

"U.S. Appl. No. 14/821,196 Office Action", dated Mar. 29, 2017, 9 pages.

(Continued)

*Primary Examiner* — Jason Skaarup
(74) *Attorney, Agent, or Firm* — DeLizio Law, PLLC

(57) ABSTRACT

A gaming system and its operations are described herein. In some embodiments, the operations can include controlling a first casino wagering game. The first casino wagering game has a first credit meter balance. The operations can further include intercepting an electronic request sent from a second device to cash out a second credit meter balance for a second casino wagering game controlled by the second device. In some examples, the gaming system is independent from the second device. The operations can further include, after intercepting the electronic request, cashing out a combined total of the first credit meter balance and the second credit meter balance.

20 Claims, 10 Drawing Sheets

(56) References Cited

U.S. PATENT DOCUMENTS 5,971,271 A 10/1999 Wynn et al.
6,146,276 A 11/2000 Okuniewics
6,280,328 B1 8/2001 Holch et al.
6,379,246 B1 4/2002 Dabrowski
6,598,788 B1 * 7/2003 Dabrowski ..... G07F 17/32 235/380
6,676,522 B2 1/2004 Rowe et al.
6,800,029 B2 10/2004 Rowe et al.
6,846,238 B2 1/2005 Wells
7,025,674 B2 4/2006 Adams et al.
7,335,106 B2 2/2008 Johnson
7,390,263 B1 6/2008 Acres
7,611,409 B2 11/2009 Muir et al.
7,686,687 B2 3/2010 Cannon et al.
7,699,703 B2 4/2010 Muir et al.
7,749,081 B1 7/2010 Acres
7,780,517 B2 8/2010 Saffari et al.
7,850,528 B2 12/2010 Wells
7,867,092 B2 1/2011 Paulsen
7,867,095 B2 1/2011 Mattice et al.
7,892,090 B2 2/2011 Walker et al.
7,905,780 B2 3/2011 Morrow et al.
7,927,211 B2 4/2011 Rowe et al.
7,950,996 B2 5/2011 Nguyen et al.
7,950,999 B2 5/2011 Morrow et al.
7,951,003 B2 5/2011 Russell
8,007,361 B2 8/2011 Walker et al.
8,029,364 B2 10/2011 Loose et al.
8,070,590 B2 12/2011 Cannon et al.
8,083,592 B2 12/2011 Wells
8,088,009 B2 1/2012 Finnimore et al.
8,088,014 B2 1/2012 Wells
8,113,956 B2 2/2012 Finnimore et al.
8,133,102 B2 3/2012 Dabrowski
8,226,474 B2 7/2012 Nguyen et al.
8,241,119 B2 8/2012 Wells
8,241,123 B2 8/2012 Kelly et al.
8,241,124 B2 8/2012 Kelly et al.
8,241,127 B2 8/2012 Kovacs
8,267,792 B2 9/2012 Buchholz et al.
8,282,480 B2 10/2012 Wells et al.
8,282,490 B2 10/2012 Arezina et al.
8,317,604 B2 11/2012 Wells
8,323,111 B2 12/2012 Finnimore et al.
8,328,632 B2 12/2012 Cannon et al.
8,333,655 B2 12/2012 Gagner et al.
8,336,697 B2 12/2012 Wells
8,342,935 B1 1/2013 Morrow et al.
8,348,759 B2 1/2013 Dimichele et al.
8,371,937 B2 2/2013 Wells
8,371,942 B2 2/2013 Finnimore et al.
8,376,837 B2 2/2013 Gagner et al.
8,388,424 B2 3/2013 Dabrowski
8,419,526 B1 4/2013 Cannon et al.
8,430,741 B2 4/2013 Agarwal et al.
8,469,800 B2 6/2013 Lemay et al.
8,475,273 B2 7/2013 Kelly et al.
8,475,283 B2 7/2013 Guinn et al.
8,495,391 B2 * 7/2013 Gatto ..... A63F 13/12 345/419
8,512,144 B2 8/2013 Johnson
8,529,345 B2 9/2013 Nguyen
8,550,900 B2 10/2013 Walker et al.
8,550,903 B2 10/2013 Lyons et al.
8,597,111 B2 12/2013 Lemay et al.
8,616,981 B1 12/2013 Guinn et al.
8,628,418 B2 1/2014 Abbot
8,678,916 B2 3/2014 Cannon et al.
8,784,206 B1 7/2014 Gronkowski et al.
8,858,323 B2 10/2014 Nguyen et al.
9,022,861 B2 * 5/2015 Wells ..... G07F 9/026 463/16
9,335,964 B2 5/2016 Khatod et al.
9,489,794 B2 11/2016 Hilbert et al.
9,734,666 B2 8/2017 Gagner et al.
2002/0025850 A1 * 2/2002 Hafezi ..... G07F 17/3202 463/29
2002/0128058 A1 * 9/2002 Rubeli ..... G07F 17/32 463/20
2002/0160831 A1 * 10/2002 Rubeli ..... G07F 17/32 463/20
2003/0054881 A1 3/2003 Hedrick et al.
2004/0142739 A1 7/2004 Loose et al.
2005/0020354 A1 1/2005 Nguyen et al.
2005/0020358 A1 1/2005 Cram
2005/0162337 A1 7/2005 Ohashi et al.
2005/0240873 A1 10/2005 Czerwinski et al.
2006/0143085 A1 6/2006 Adams et al.
2006/0252530 A1 11/2006 Oberberger et al.
2007/0021198 A1 1/2007 Muir et al.
2007/0105613 A1 5/2007 Adams et al.
2007/0111787 A1 5/2007 Adams et al.
2007/0243925 A1 10/2007 Lemay et al.
2007/0243934 A1 10/2007 Little
2008/0009344 A1 1/2008 Graham et al.
2008/0076572 A1 3/2008 Nguyen et al.
2008/0113802 A1 5/2008 Johnson et al.
2008/0113820 A1 5/2008 Tedsen et al.
2008/0161107 A1 7/2008 Johnson
2008/0234029 A1 9/2008 Cannon et al.
2008/0248865 A1 10/2008 Tedesco et al.
2008/0305862 A1 12/2008 Walker et al.
2009/0042634 A1 2/2009 Cannon et al.
2009/0098943 A1 4/2009 Weber et al.
2009/0104954 A1 4/2009 Weber et al.
2009/0233705 A1 9/2009 Lemay et al.
2010/0087241 A1 4/2010 Nguyen et al.
2010/0210352 A1 8/2010 Ansari et al.
2010/0210353 A1 * 8/2010 Gagner ..... G07F 17/32 463/25
2011/0009188 A1 1/2011 Adiraju et al.
2011/0053672 A1 * 3/2011 Gagner ..... G07F 17/32 463/16
2011/0195792 A1 8/2011 Wells et al.
2011/0263325 A1 10/2011 Atkinson
2012/0077560 A1 3/2012 Cannon et al.
2012/0108338 A1 5/2012 Wells et al.
2012/0122558 A1 5/2012 Lyons et al.
2012/0122560 A1 5/2012 Loose et al.
2013/0017884 A1 1/2013 Price et al.
2013/0023339 A1 1/2013 Davis et al.
2013/0053136 A1 2/2013 Lemay et al.
2013/0053148 A1 2/2013 Nelson et al.
2013/0059648 A1 3/2013 Rowe et al.
2013/0072289 A1 * 3/2013 Nelson ..... G07F 17/3225 463/25
2013/0072310 A1 3/2013 Wells
2013/0084963 A1 4/2013 Shorrock et al.
2013/0084972 A1 4/2013 Frady
2013/0084973 A1 4/2013 Frady
2013/0095904 A1 4/2013 Cannon et al.
2013/0130779 A1 5/2013 Gagner et al.
2013/0130782 A1 5/2013 Hornik et al.
2013/0130806 A1 5/2013 Gagner et al.
2013/0178271 A1 7/2013 Aponte et al.
2013/0196755 A1 8/2013 Nelson et al.
2013/0231192 A1 9/2013 Walker et al.
2013/0252714 A1 9/2013 Buchholz et al.
2013/0260889 A1 10/2013 Lemay et al.
2013/0274016 A1 10/2013 Gagner et al.
2013/0331164 A1 * 12/2013 Patta ..... G07F 17/3244 463/16
2013/0337889 A1 12/2013 Gagner et al.
2013/0337890 A1 12/2013 Earley et al.
2014/0031107 A1 1/2014 Walker et al.
2014/0045582 A1 2/2014 Lyons et al.
2014/0094272 A1 4/2014 Kelly et al.
2014/0141864 A1 5/2014 Ward et al.
2014/0248941 A1 9/2014 Nelson et al.
2014/0287822 A1 9/2014 Young

(56) References Cited

U.S. PATENT DOCUMENTS

| | | | |
|---|---|---|---|
| 2015/0348361 | A1 | 12/2015 | Adiraju |
| 2016/0042599 | A1 | 2/2016 | Toohey et al. |

OTHER PUBLICATIONS

"Australian Patent Application No. 2015210435, Examination Report", dated Dec. 16, 2016, 4 pages.
Co-Pending U.S. Appl. No. 14/821,196, filed Aug. 7, 2015, 82 pages.
"U.S. Appl. No. 14/821,196 Office Action", dated Oct. 31, 2017, 13 pages.

* cited by examiner

CASHING OUT INDEPENDENT WAGERING GAMES

RELATED APPLICATIONS

This application claims the priority benefit of U.S. Provisional Application Ser. No. 61/980,402 filed Apr. 16, 2014. The Ser. No. 61/980,402 Application is incorporated herein by reference in its entirety.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

TECHNICAL FIELD

Embodiments of the inventive subject matter relate generally to wagering game systems and networks and, more particularly, cashing out wagering games.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

In an effort to develop those new games and gaming enhancements, one or more manufacturers have developed technology to preset multiple independent wagering games simultaneously, including presenting secondary wagering games from a third-party source. While presenting independent secondary wagering games can add to the entertainment value of a wagering game machine, it can also present certain challenges. For example, if a primary wagering game and secondary wagering game are controlled by separate sources, then coordination of game data and game functionality of the games can be challenging. Furthermore, if funds for a primary wagering game are managed separately from funds for a secondary wagering game, then coordination of financial information from both games becomes a challenge. For example, currently wagering game machines are configured to only cash out a primary wagering game when a cash-out button is selected, and not a third-party, secondary wagering game.

BRIEF DESCRIPTION OF THE DRAWING(S)

Embodiments are illustrated in the Figures of the accompanying drawings in which.

Figure 4:
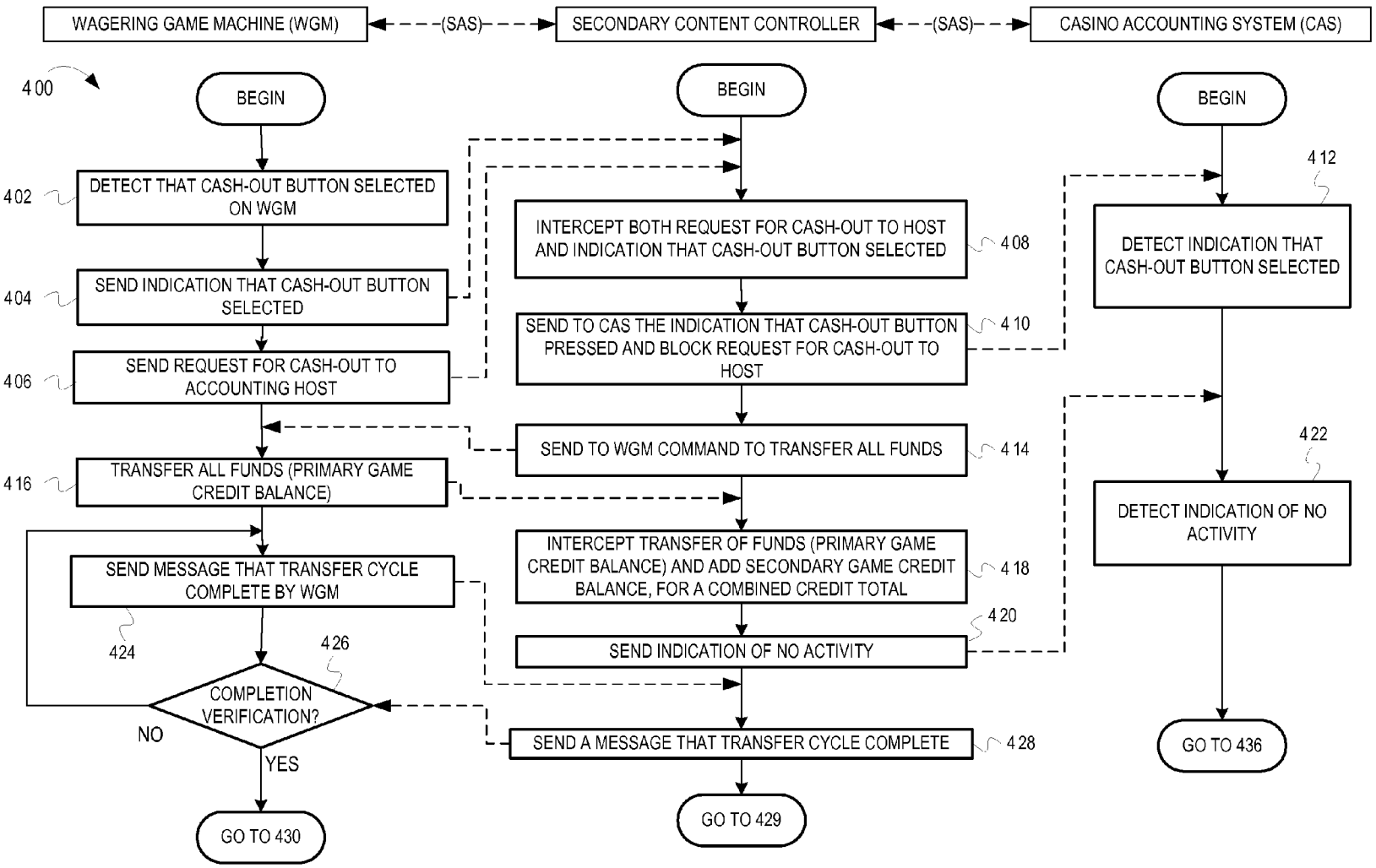
Figure 5:
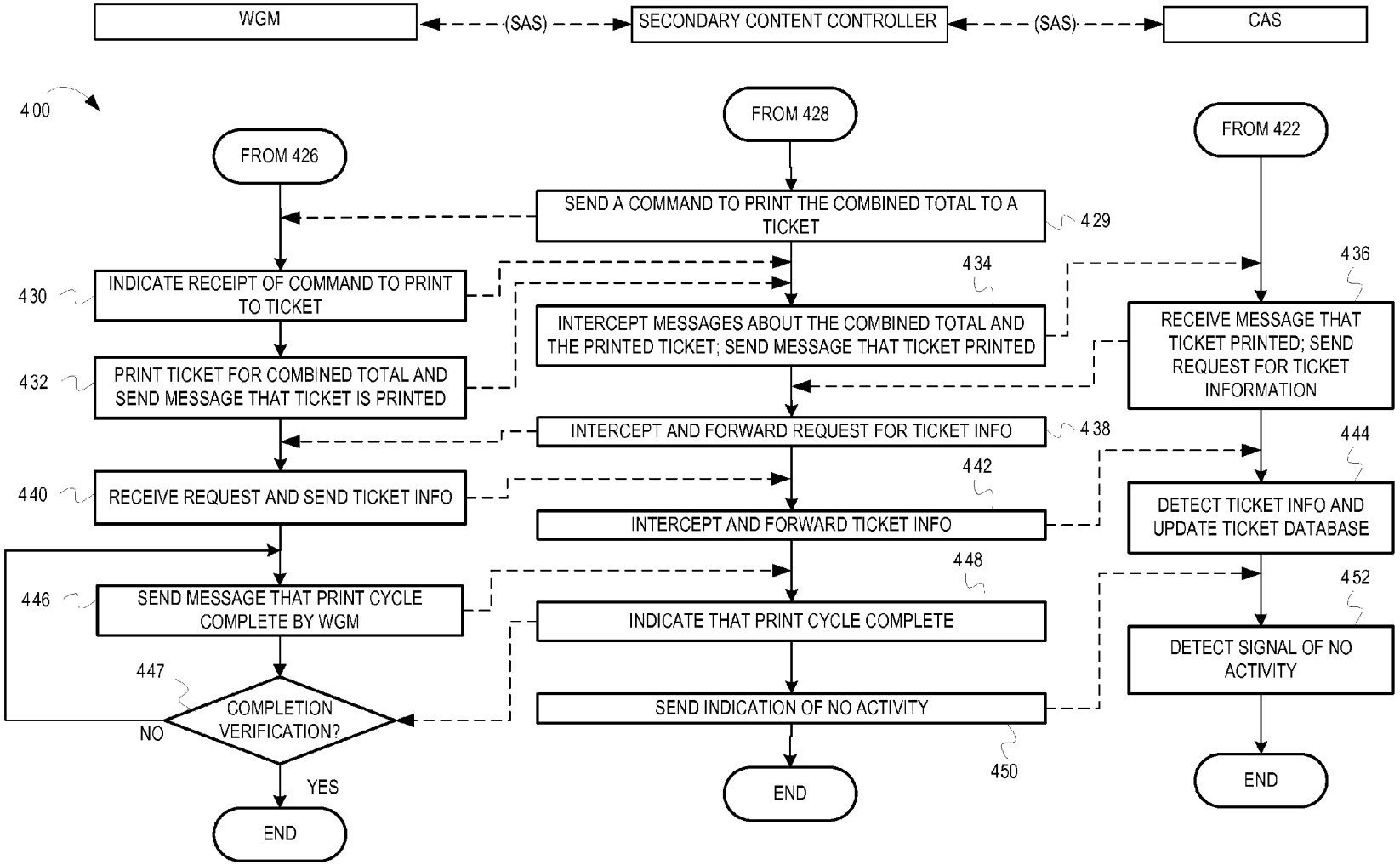
Figure 7:
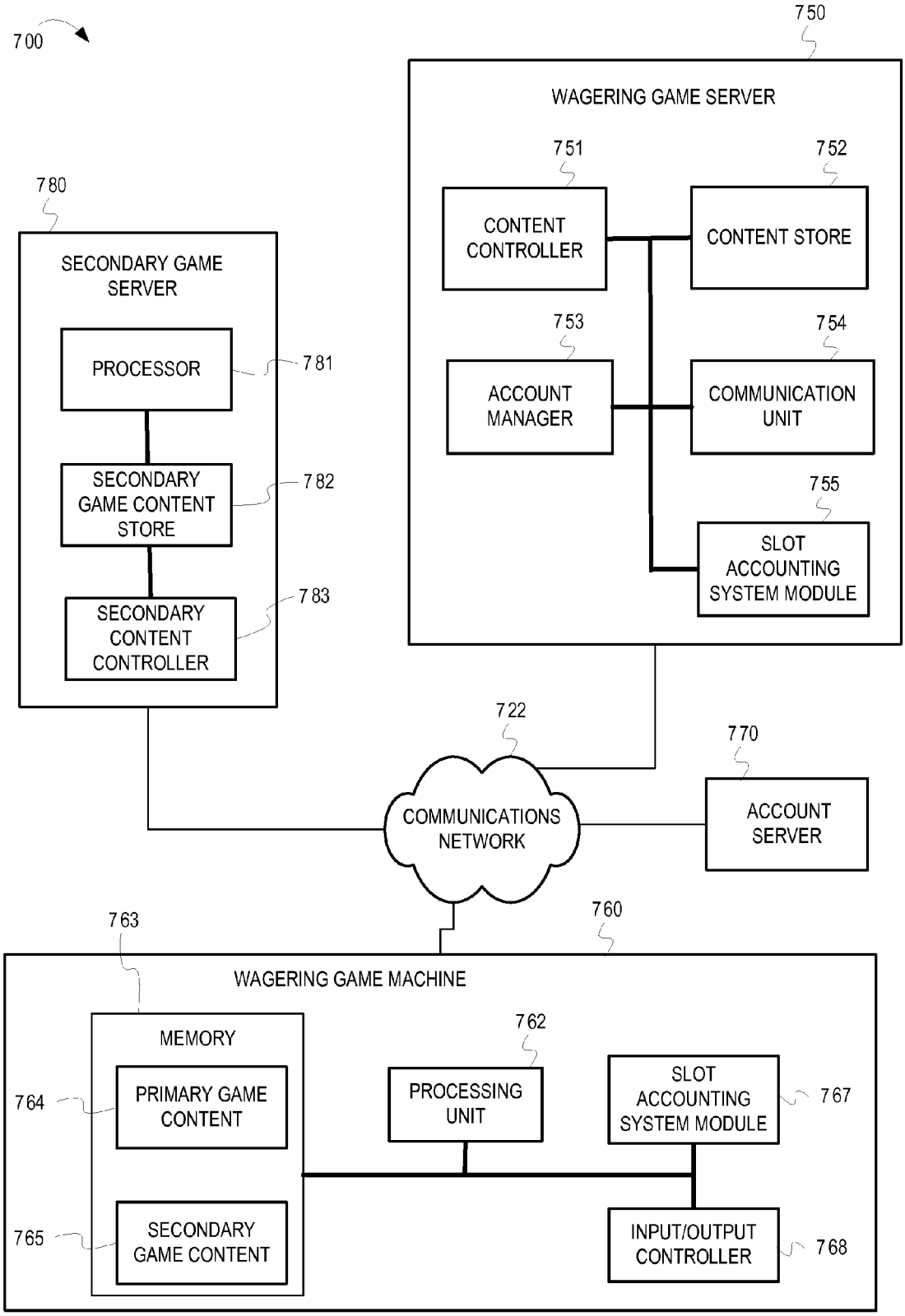
Figure 8:
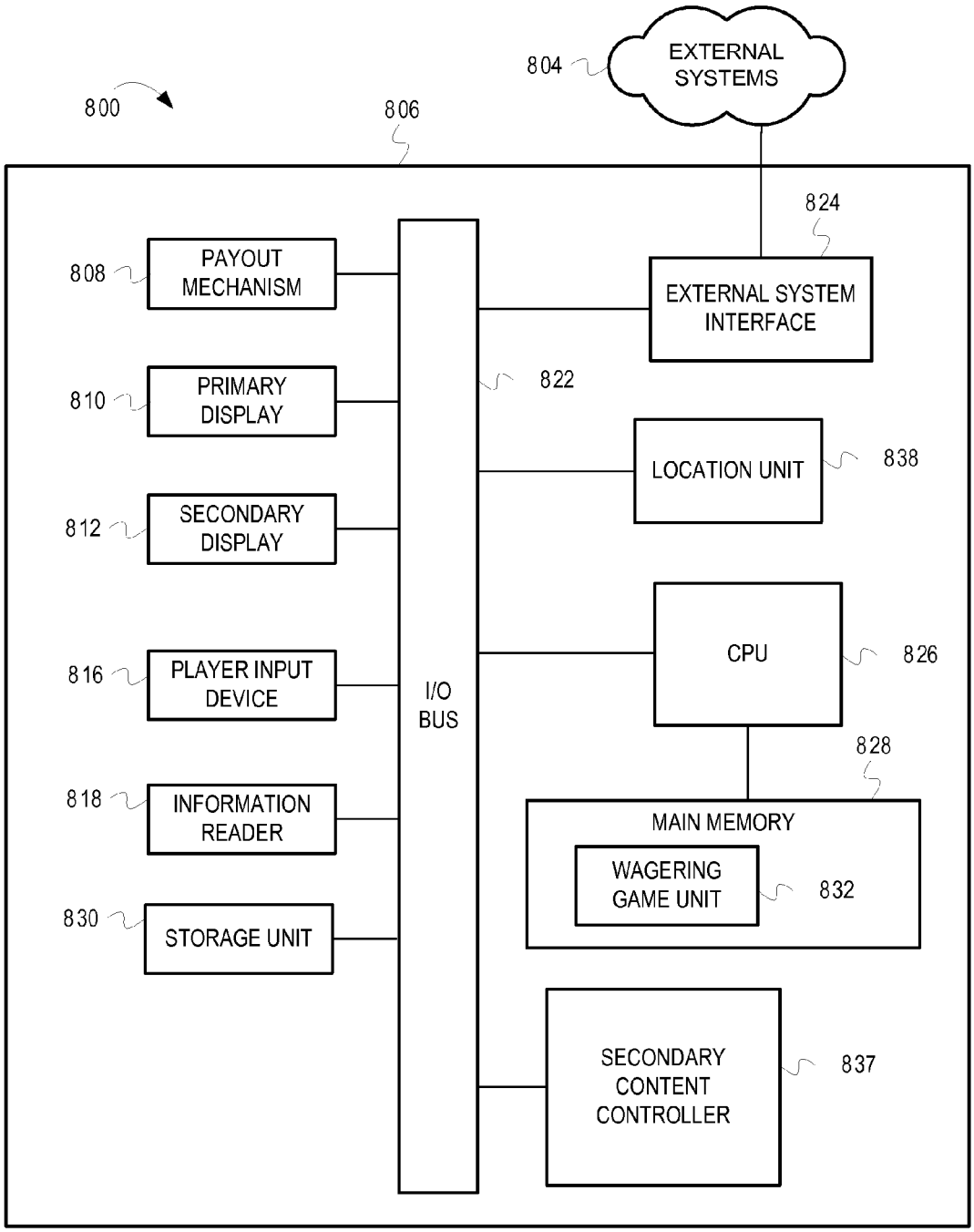
Figure 9:
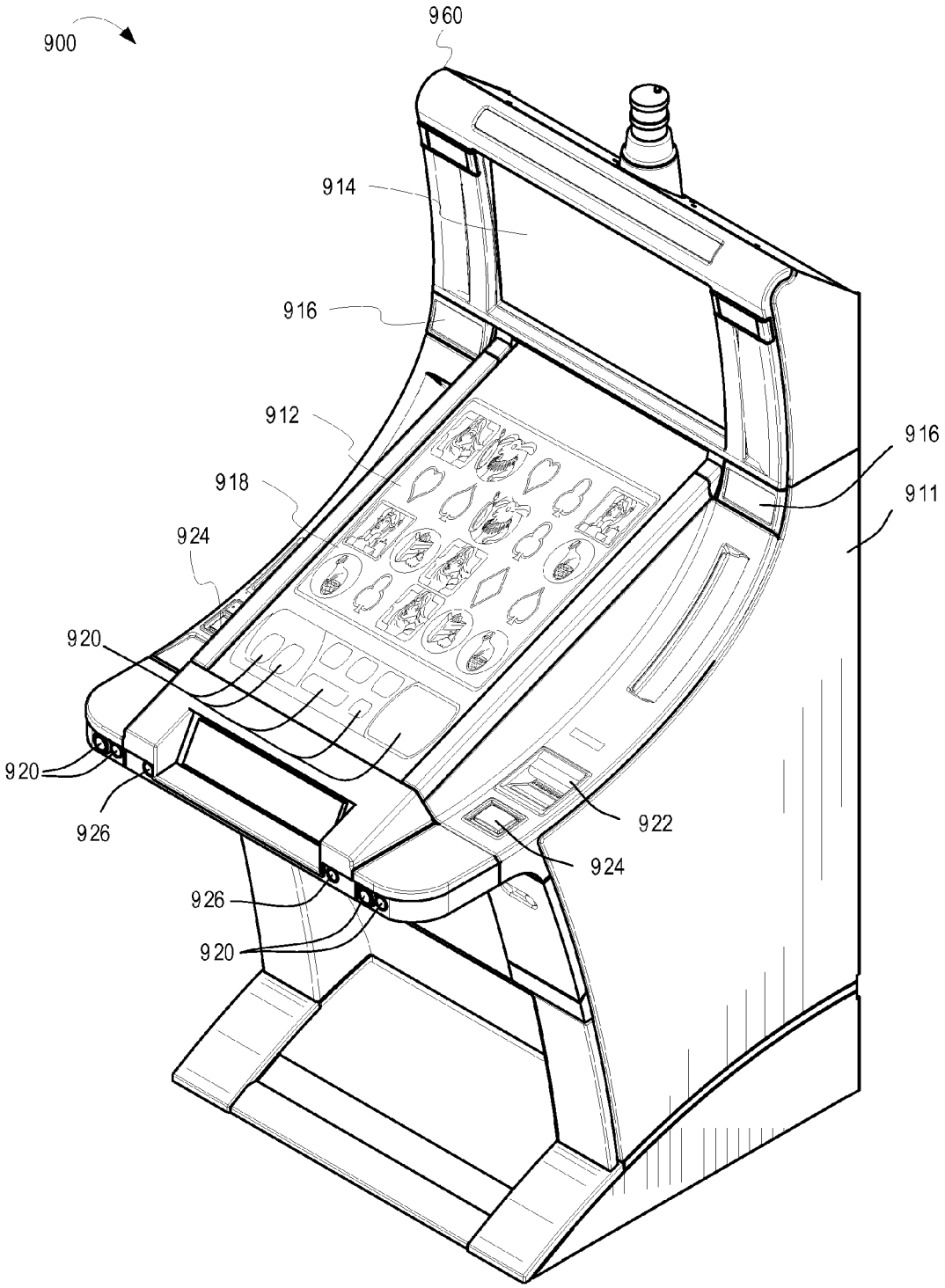

FIGS. 4 and 5 include a flow diagram 400 for illustrating cashing out multiple, independent wagering games, according to some embodiments;

FIGS. 6A-6F are illustrations of cashing out multiple, independent wagering games, according to some embodiments;

FIG. 7 is an illustration of a wagering game system architecture 700, according to some embodiments;

FIG. 8 is an illustration of a wagering game machine architecture 800, according to some embodiments; and FIG. 9 is an illustration of a wagering game system 900, according to some embodiments.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

For purposes of the present detailed description, a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Furthermore, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or online casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Further, some embodiments of the inventive subject matter describe examples of cashing out multiple independent wagering games in a network wagering venue (e.g., an online casino, a wagering game website, a wagering network, etc.) using a communication network. Embodiments can be presented over any type of communications network that provides access to wagering games, such as a public network (e.g., a public wide-area-network, such as the Internet), a private network (e.g., a private local-area-network gaming network), a peer-to-peer network, a social network, etc., or any combination of networks. Multiple users can be connected to the networks via computing devices. The multiple users can have accounts that utilize specific services, such as account-based wagering services (e.g., account-based wagering game websites, account-based casino networks, etc.).

Introduction

This section provides an introduction to some embodiments.

Wagering games are expanding in popularity. Wagering game enthusiasts expect continuous innovations to the wagering game experience. As such, wagering game companies are interested in creating and providing innovative wagering games and gaming features to the demanding public. As mentioned previously, some wagering game manufacturers have developed ways to present a primary wagering game on a display and concurrently present a secondary wagering game, from an independent, third-party source, on the display in addition to the primary game. However, because the games come from different independent sources, the financial aspects of the independent games are not closely connected, if at all. Therefore, until now, cashing out the primary wagering game would not automatically cash out an independent secondary wagering game. Some embodiments of the inventive subject matter, however, provide ways to, in response to a single user input, cash out a primary wagering game as well as one or more independently presented secondary wagering games.

Figure 1:
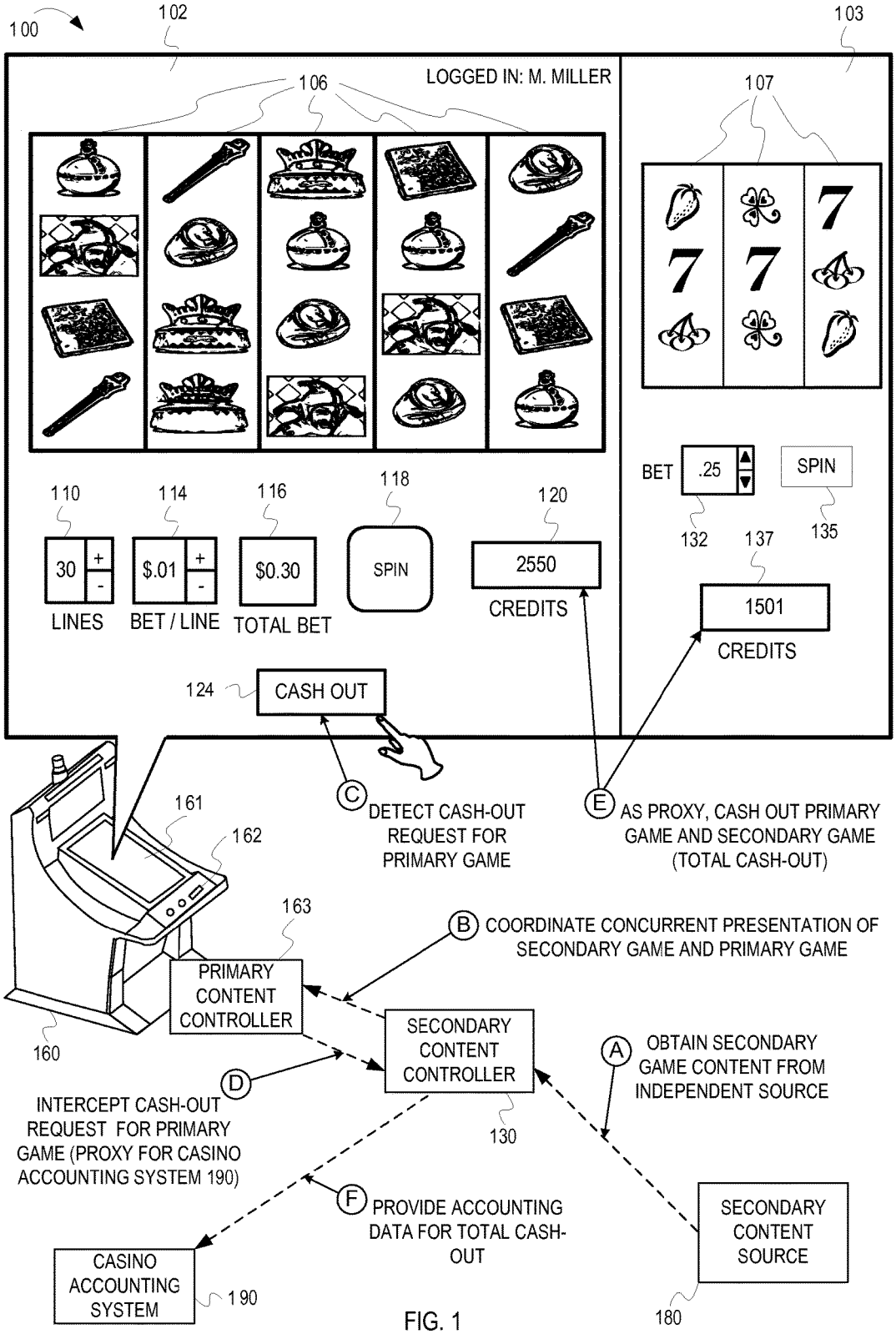
FIG. 1 is an illustration of cashing out multiple, independent wagering games, according to some embodiments.

FIG. 1 is a conceptual diagram that illustrates an example of cashing out multiple, independent wagering games, according to some embodiments. In FIG. 1, a wagering game system ("system 100") includes a wagering game machine 160. The wagering game machine 160 includes components that present and/or control wagering game content. For example, a primary content controller 163 associated with the wagering game machine 160 can present and/or control the presentation of a first wagering game ("primary wagering game 102"). In some embodiments, the primary content controller 163 is incorporated into the wagering game machine 160. In some embodiments, the primary content controller 163 is configured for a client-server architecture. For instance, the primary content controller 163 can control a client application from the wagering game machine 160. In some embodiments, the client application is a Rich Internet Application (RIA), such as an application that uses the Adobe® Flash® Platform, the Oracle® JavaFX® Platform, the Microsoft® Silverlight® Platform, etc. The client application can present wagering game content via the wagering game machine 160, such as the primary wagering game 102. The client application can receive user input, such as a user selection of a payline control 110 (to select a number of pay lines), a bet-per-payline control 114 (an amount to bet on each of the pay lines), or a spin control 118 (to spin virtual reels 106 for the primary wagering game 102). A wagering game server can run a server application. The server application can receive the user data from the client application. The server application can generate control data for the primary wagering game 102 in response to the user data and send the control data to the client application running on the wagering game machine 160. The client application can receive the control data from the wagering game server and alter the presentation of the primary wagering game 102 based on the control data. In some embodiments, the wagering game machine 160 is connected to the wagering game server via a communications network.

The wagering game machine 160 is configured to present the primary wagering game 102 via a display 161, and/or via other output devices, such as a speakers, peripheral devices, etc. The content for the primary wagering game 102 originates from a primary game source, such as from a memory device included in the wagering game machine 160 and/or from a wagering game server external to the wagering game machine 160.

The wagering game system 100 also includes a secondary content controller 130. The secondary content controller 130 is connected to a secondary content source 180. The secondary content controller 130 accesses, from the secondary content source 180, secondary wagering game content, such as content for a secondary wagering game 103. The secondary content controller 130 controls and presents the secondary wagering game 103 on the display 161 of the wagering game machine 160 at the same time that the primary wagering game 102 is presented on the display 161. However, the secondary content controller 130 operates independently from the primary content controller 163. In other words, the content from the primary wagering game 102 is presented and/or controlled separately and independently from content for the secondary wagering game 103. For instance, the secondary content controller 130 can have separate hardware, software, firmware, or a combination thereof, from that of the primary content controller 163. For instance, the secondary content controller 130 can use separate processors and separate memory devices than those used by the primary content controller 163. Further, the secondary content controller 130 can run a first game application that is separate and independent from a second game application run by the primary content controller 163. Thus, the game logic, game theme, denomination values, pay tables, bonuses, functionality, etc. for the first game application can be different from, and independent of, those for the second game application. Therefore, according to some embodiments, the primary content controller 163 may control game content from a first game provider while the secondary content controller 130 controls game content from a different game provider.

In some embodiments, the secondary content controller 130 is incorporated into a device separate from the wagering game machine 160. The separate device can be communicatively coupled to the wagering game machine 160, such as via a wired connection or a wireless link. In other embodiments, however, the secondary content controller 130 may be incorporated into the wagering game machine 160. For example, the secondary content controller 130 may be contained entirely within a cabinet or casing for the wagering game machine 160. In some embodiments, the secondary content controller 130 may be embedded into the wagering game machine 160 as an embedded system, a single board computer, a single board smart interface, a system host board, etc. In some embodiments, the secondary content controller 130 may be included on a motherboard of the wagering game machine 160 or attached as a daughterboard. In some embodiments, the secondary content controller 130 may be plugged into a backplane or riser card expansion slot of a motherboard of the wagering game machine 160. Examples of expansion slots may include an Industry Standard Architecture (ISA) expansion slot, a Conventional Peripheral Component Interconnect (PCI) expansion slot, a PCI eXtended (PCI-X) expansion slot, a PCI Express (PCI-e) expansion slot, and so forth.

The wagering game system 100 also includes a casino accounting system 190. In some embodiments, the casino accounting system 190 is incorporated into, or directly connected to, the wagering game machine 160. For instance, the casino accounting system 190 may also be contained entirely within the cabinet or casing for the wagering game machine 160. The casino accounting system 190 may also be embedded into the wagering game machine 160, included on the motherboard of the wagering game machine 160, attached as a daughterboard, plugged into a backplane or riser card expansion slot of the motherboard of the wagering game machine 160, etc. In other embodiments, however, the casino accounting system 190 may be separate from the wagering game machine 160. For example, the casino accounting system 190 may be incorporated into a server separate from the wagering game machine 160.

The casino accounting system 190 is configured to receive data messages from, and send data messages to, either or both of the primary content controller 163 and the secondary content controller 130. For example, the casino accounting system 190 is configured to send and receive data messages using the Slot Accounting System (SAS) protocol commercially available from International Game Technology (IGT) of Las Vegas, Nev. The casino account system 190 is configured to perform operations that can separately account for certain financial transactions made for the primary wagering game 102 and/or the secondary wagering game 103. For example, the casino accounting system 190 is configured to communicate with the primary content controller 163 when the primary wagering game 102 is cashed out. In other words, when a user indicates that he or she is done playing the primary wagering game 102, the user may initiate a "cash out" procedure, such as by pressing the cash-out button 124 associated with the wagering game machine 160. The casino accounting system 190 is configured to communicate with the primary content controller 163 to account for financial data associated with the cash out of the primary wagering game 102. In some embodiments, the primary content controller 163 is specifically manufactured and/or configured by the same game provider that manufactures the wagering game machine 160. Thus, the programming for the primary content controller 163 is specifically configured for use with the wagering game machine 160. Therefore, in some embodiments, the cash-out button 124 may be specifically programmed to initiate a cash-out procedure for only the primary wagering game 102. The cash-out procedure for the primary wagering game 102 is configured to communicate directly with the casino account system 190 during the cash out procedure.

As mentioned previously, the secondary content controller 130 can operate independently from the primary content controller 163. For example, the secondary content controller 130 may originate from a different manufacturer than the manufacturer for the wagering game machine 160 or the primary content controller 163. Further, the secondary wagering game 103 may come from a third-party source separate from a game provider for the primary wagering game 102. Thus, in some embodiments, when the cash-out button 124 is activated for the primary wagering game 102, it would not automatically initiate a procedure to cash out the secondary wagering game 103. Notwithstanding, according to some embodiments, the secondary content controller 130 is configured to detect when the cash-out procedure for the primary wagering game 102 is activated and perform operations that will simultaneously cash out both the primary wagering game 102 and the secondary wagering game 103. The secondary content controller 130 intercepts accounting data messages sent by the primary content controller 163 which are intended for the casino accounting system 190. The secondary content controller 130 acts as a proxy for the casino accounting system 190 during the cash out procedure of both the primary wagering game 102 and the secondary wagering game 103. The secondary content controller 130 then reports to the casino accounting system 190 summary information regarding cash-out amounts for both the primary wagering game 102 and the secondary wagering game 103.

The following paragraphs illustrate examples operations performed by the secondary content controller 130, through various stages "A" through "F." The operations of stages "A" through "F" illustrate one example of how the secondary content controller 130 presents the secondary wagering game 103 via the display 161 and then cashes out both the primary wagering game 102 and the secondary wagering game 103 when the cash-out button 124 is activated for the primary wagering game 102.

At stage "A," the secondary content controller 130 accesses content for the secondary wagering game 103. For example, the secondary content controller 130 accesses content for the secondary wagering game 103 from the secondary content source 180.

At stage "B," the secondary content controller 130 coordinates concurrent presentation of the primary wagering game 102 and the secondary wagering game 103. As mentioned previously, because the secondary content controller 130 may originate from a different source (e.g., a different manufacturer, game provider, etc.) than for the wagering game machine 160 or the primary content controller 163, the secondary content controller 130 does not natively have access to the resources of the wagering game machine 160. Thus, according to some embodiments, the secondary content controller 130 is configured to interpose itself between the primary content controller 163 and various elements of the wagering game machine 160 that present content. For example, the secondary content controller 130 can interpose itself between the primary content controller 163 and the display 161. The secondary content controller 130 intercepts native video content generated by the primary content controller 163 before the native video content can be presented on the display 161. The secondary content controller 130 can modify the native video content for the primary wagering game 102 so that it appears modified (e.g., smaller or moved) on the display 161 to make room on the display 161 for the secondary wagering game 103. The secondary content controller 130 can then generate video content for the secondary wagering game 103 and send it to the display 161 for simultaneous presentation with the modified video content for the primary wagering game 102. Thus, in some embodiments, the secondary content controller 130 is configured to move, resize, reorient, or rearrange a placement of the primary wagering game 102 to accommodate presentation of the secondary wagering game 103 on the same display 161. The secondary content controller 130 then presents the secondary wagering game 103 concurrently with the presentation of the primary wagering game 102.

Furthermore, in some embodiments, the secondary content controller 130 is configured to intercept a player's touch inputs made on a touch-screen of the display 161. The secondary content controller 130 sends touch input that corresponds to the primary wagering game 102 to the primary content controller 163 so that the primary content controller 163 can control the primary game according to the touch input. More specifically, depending on where the player's touch inputs are made on the display 161, the secondary content controller 130 determines whether touch inputs relate to the primary wagering game 102 or the secondary wagering game 103. The secondary content controller 130 then uses the touch input as controls for either the primary wagering game 102 or the secondary wagering game 103. For example, the secondary content controller 130 detects when a player presses one or more first virtual buttons on the display (e.g., the payline control 110, the bet-per-payline control 114, or the spin control 118). The secondary content controller 130 can intercept the touch input received from the display 161 for the first virtual buttons and correlate the input to positions of the first virtual buttons on the display 161. Specifically, the secondary content controller 130 can receive raw touch data from the display 161. The secondary content controller 130 determines whether any touch data has been received in the area of the display 161 associated with the primary wagering game 102. When the secondary content controller 130 detects that touch data is associated with the primary wagering game 102, the secondary content controller 130 interpolates the touch data associated with the modified presentation of the primary wagering game 102 to a native format of the touch data expected by the primary content controller 163. The interpolation is necessary because the primary content controller 163 is programmed to operate on the received touch data as if the primary wagering game 102 occupied the entire display 161 as opposed to the modified presentation of the primary wagering game 102 caused by the secondary content controller 130.

Further, the secondary content controller 130 can detect input via the display 161 for one or more aspects of the secondary wagering game 103, such as when a player touches one or more second virtual buttons (a bet control 132 and a spin control 135 to spin virtual reels 107 for the secondary wagering game 103). The secondary content controller 130 uses the touch input that corresponds to the secondary game to control the secondary wagering game 103.

At stage "C," the secondary content controller 130 detects a selection of a cash-out button 124 associated with the primary wagering game 102. The cash-out button 124 is configured to initiate a cash-out procedure that only cashes out a first credit-meter balance shown in a first credit meter 120 for the primary wagering game 102. The cash-out button 124 is not configured to initiate a cash-out procedure for a second credit-meter balance shown in a second credit meter 137 for the secondary wagering game 103. When the cash-out button 124 is selected, the primary content controller 163 for the wagering game machine 160 generates a cash-out request. For example, the primary content controller 163 generates a Slot Accounting System (SAS) data message that is intended for a cash-out accounting host, such as the casino accounting system 190.

At stage "D," the secondary content controller 130 intercepts the cash-out request for the primary wagering game 102. In other words, the secondary content controller 130 interposes itself between the primary content controller 163 and the casino accounting system 190. The secondary content controller 130 acts as a proxy for the casino accounting system 190 and intercepts cash-out type communications made by the primary content controller 163 that, absent the presence of the secondary content controller 130, would be handled by the casino accounting system 190. The secondary content controller 130 also blocks the request from being sent to the casino accounting system 190.

At stage "E," the secondary content controller 130 then responds to the cash-out request in a way that cashes out both the first credit-meter balance and the second credit-meter balance for a total combined cash-out amount. For instance, secondary content controller 130, through a series of funds transfers between the primary content controller 163, combines the first credit-meter balance (e.g., the "2550" credit value shown in the first credit meter 120) with the second credit-meter balance (e.g., the "1501" credit value shown in the second credit meter 137), and causes the wagering game machine 160 to generate a cash-out for the total combined cash-out amount (e.g., to print out a ticket for a combined credit value of "4051" credits). In some embodiments, the wagering game machine 160 is configured so that a first cash-out mode is enabled (e.g., a soft cash-out mode, a cash-out to host mode, and/or a cash-out to card mode.) that uses the Slot Accounting System (SAS) protocol. Thus, Advanced Funds Transfers (AFTs) can occur between the primary content controller 163 and the secondary content controller 130 after the cash-out button 124 is selected. When the primary content controller 163 sends SAS communications to the accounting host, the secondary content controller 130 intercepts the SAS communications and functions as the accounting host in the first cash-out mode instead of the casino accounting system 190. While the secondary content controller 130 intercepts communications from the primary content controller 163 related to the first cash-out mode, the secondary content controller 130 sends SAS communications to the casino accounting system 190 as if the primary wagering game 102 were being cashed out in a second cash-out mode (e.g., a hard cash-out mode, a cash-out to ticket mode, etc.). The second cash-out mode does not make use of AFT transfers and it provides a report of a total amount cashed out to a ticket. Consequently, the casino accounting system 190 is not expecting any funds transfers. As a result, the secondary content controller 130 can intercept and use the AFT funds transfers to and from the primary content controller 163 to combine and concurrently cash out both the first credit-meter balance for the first credit meter 120 and the second credit-meter balance for the second credit meter 137.

At stage "F," the secondary content controller 130 provides accounting data for the total combined cash-out amount to the casino accounting system 190. For instance, the secondary content controller 130 reports the accounting data for the total combined cash-out amount as if the primary content controller 163 had cashed out the total combined amount in the second cash-out mode.

Although FIG. 1 describes some embodiments, the following sections describe many other features and embodiments.

Example Operating Environments

This section describes example operating environments and presents structural aspects of some embodiments. More specifically, this section includes discussion about a wagering game system architecture.

Wagering Game System Architecture

Figure 2:
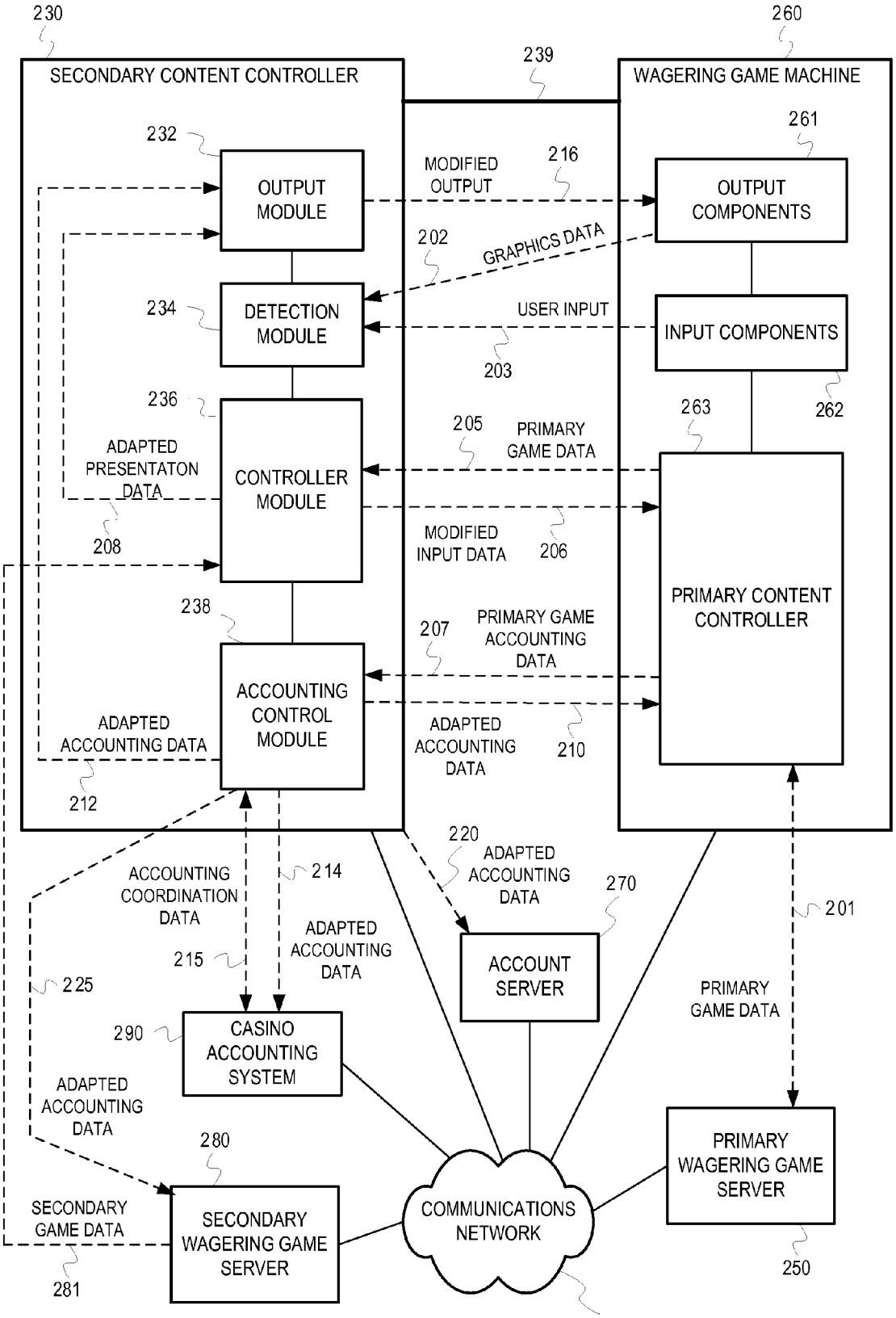
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 includes a wagering game machine 260 similar to the wagering game machine 160 described in FIG. 1. The wagering game machine 260 is configured to present and control wagering games as well as other content associated with the wagering games. The wagering game machine 260 includes one or more output related components and devices ("output components 261") configured to control and/or present output information related to the wagering games and the other content. For example, the wagering game machine 260 includes one or more display devices that present wagering game content for the wagering games, content for casino services, content for advertisements, and so forth. The output components 261 further include video and graphics devices or engines that generate an image of content to present via the one or more displays associated with the wagering game machine 260. In another example, the output components 261 includes speakers, sound cards, etc. that generate and/or present signals and sounds for the wagering games and other content. In another example, the output components 261 include one or more payout mechanisms, such as printer that prints out tickets, coupons, etc. related to the wagering games. For example, the printer can print out a ticket that shows a cash-out amount for one or more wagering games concurrently presented via the wagering game machine 260. In yet another example, the wagering game machine 260 includes various lighting devices that show information related to wagering games, such as lighting effects (e.g., a celebratory effect, an attract effect, etc.).

The wagering game machine 260 also includes one or more input related components and devices ("input components 262") configured to control and/or provide input for the wagering games and other content presented via the wagering game machine 260. For example, the input components 262 include a touch-screen display by which a user can touch a screen and select certain virtual controls, objects, items, etc. presented on the touch-screen display. In another example, the input components 262 include a button panel with buttons related to one or more wagering games, application, services, etc. presented via the wagering game machine 260. The buttons, for example, may indicate betting amounts, payline amounts, spin controls, or other items used to make bets, spin reels, etc. for a wagering game. The buttons may also detect input related to payout mechanisms and/or cashing out a wagering game, such as an activation of a cash-out button used to transfer credits from wagering game credit balances to a cash-out object, card, ticket, account, etc. The buttons may also accept input related to casino services and amenities. In some examples the input components 262 also includes input devices related to funds, player information, etc. For example, the wagering game machine 260 includes an information reader that reads information from a card or device and connects to a player account, a customer loyalty account, a financial account, etc. In some examples, the information reader can communicate with a mobile device, such as a player's personal mobile device. In yet other examples, the input components 262 include eye tracking equipment, biometric devices, and so forth.

The wagering game machine 260 also includes a primary content controller 263 configured to control content, such as a primary wagering game or other wagering games, provided from a primary source of wagering game content. The primary content controller 263 can include software and hardware, such as a processor, memory devices, an operating system, game applications, etc. For example, a primary wagering game server 250 can provide primary game data 201 to the primary content controller 263, such as control and application data for one or more client applications controlled by the primary content controller 263.

The wagering game system architecture 200 also includes a secondary content controller 230 configured to communicate with various components of the wagering game machine 260 to present and control various aspects of independent secondary content using the output components 261 and the input components 262 of the wagering game machine 260. In some examples, the secondary content controller 230 is similar to the secondary content controller 130 described in FIG. 1. For example, the secondary content controller 230 may be incorporated into the wagering game machine 260 (e.g., plugged into an expansion slot on a motherboard of the wagering game machine 260). In other embodiments, the secondary content controller 230 is external to the wagering game machine 260 and is connected to the wagering game machine 260 via a communications connection 239 (e.g., plugged into an Ethernet port of the wagering game machine 260, connected wirelessly to a wagering game machine 260, etc.).

The secondary content controller 230 includes a detection unit 234 configured to detect information from the various devices and components of the wagering game machine 260 including information from the output components 261 and the input components 262. For example, the detection module 234 detect graphics data 202 (e.g., graphical and video data) provided from a video card, a graphics engine, or other sources of graphics data of the wagering game machine 260. The detection module 234 sends the graphics data 202 to the controller module 236. The graphics data 202 includes a position of primary wagering game content on a display of the wagering game machine 260 according to default display parameters (e.g., default size of a display area, default display dimensions, etc.). The controller module 236 manipulates the graphics data 202 to move or resize the position of the primary wagering game content relative to the default display parameters. The controller module 236 sends modified or adapted presentation data 208 to the output module 232, such as display coordinates, display boundaries, display sizes, or other display data for the primary wagering game content that has been moved or resized to accommodate the presentation of an independent secondary wagering game. The output module 232 receives the adapted presentation data and provides modified output data 216 to the output components 261. The output components 261 use the modified output data 216, for example, to move or resize the primary game content on a display device of the wagering game machine 260. Furthermore, the controller module 236 receives secondary game data 281 from the secondary wagering game server 280. The controller module 236 further includes in the adapted presentation data 208 information about where to position a secondary wagering game relative to the position of the primary game content. The output module 232 then incorporates in the modified output data 216 information about both the secondary game content and the primary game content so that the display device of the wagering game machine 260 can concurrently present both the primary and secondary game content.

Further, in some embodiments, the detection module 234 intercepts user input 203 from the input components 262 and provides the user input 203 to the controller module 236. The controller module 236 receives the user input 203, interprets the user input 203, and, in some cases, modifies the user input 203 to the adapted presentation data 208. The controller module 236 further provides modified input data 206 to the primary content controller 263. For instance, the detection unit 234 intercepts a touch-screen input from the input components 262 before the primary content controller 263 can detect the touch-screen input. The detection unit 234 forwards the touch-screen input to the controller module 236. The controller module 236 converts or remaps the touch-screen input to different coordinates of the touch-screen display that relate to a modified location of primary content on the display as well as to secondary content presented on the display. The controller module 236 sends the modified input data 206 to the primary content controller 263 so that the primary content controller 263 can control the primary game according to the modified input data 206. The controller module 236 further detects primary game data 205 generated by the primary content controller 263 so that the controller module 236 can generate updates to the adapted presentation data 208.

The secondary content controller 230 also includes an accounting control module 254 configured to receive from the detection module 234 user input 203 that relates to financial transactions, such as credit transfers, cash outs, etc. For instance, the detection module 234 detects that a cash-out button is selected at the wagering game machine 260 from a virtual button on a display or from a physical button on a control panel of the wagering game machine 260. The detection module 234 forwards the user input 203 related to the selection of the cash-out button to the accounting control module 238. The accounting control module 238 responds to the selection of the cash-out button with a series of operations that causes a credit-meter balance for a secondary wagering game to be combined with a credit-meter balance for the primary game. For instance, the accounting control module 254 intercepts primary game accounting data 207, such as Slot Accounting System (SAS) messages sent from the primary content controller 263 for a soft cash out (e.g., for a cash-out to accounting host process) with the casino accounting system 290. The accounting control module 238 then acts as proxy for the casino accounting system 290 by generating adapted accounting data 210, which the accounting control module 238 communicates to the primary content controller 263. Thus, in some embodiments the accounting control module 238 interposes itself, or intervenes, between the primary content controller 263 and the casino accounting system 290 (e.g., as if the accounting control module 238 were the accounting host for which the cash-out to accounting host process was intended). For instance, the accounting control module 238 intercepts a funds transfer from the primary content controller 263 for a primary game credit balance. The accounting control module 238 adds the primary game credit balance to a secondary game credit balance to generate a combined credit total. Then, the accounting control module 238 transfers the combined credit total to the primary content controller 263 along with a command to cash out the combined total to a single payout mechanism, such as to print the combined credit total to a ticket. In some embodiments, the primary content controller 263 receives the adapted accounting data 210 and responds to the adapted accounting data 210, such as by printing a ticket from a printer included in the output components 261 for the combined total. In another example, the accounting control module 238 sends adapted accounting data 212 to the output module 232, and the output module 232 sends a command to the printer in the output components 261 to print the ticket.

Furthermore, the accounting control module 238 sends adapted accounting data 214 to the casino accounting system 290. For instance, the accounting control module 238 sends accounting data to the casino accounting system 290 as if the primary content controller 263 had initiated a second cash-out mode (e.g., a hard cash-out mode or cash-out to ticket mode), not the first cash-out mode (e.g., the soft cash-out mode, cash-out to card, or cash-out to host). The second cash-out mode does not require a transfer of funds between the primary content controller 263 and an accounting host. As such, the accounting control module 238 sends to the casino accounting system 290 only an indication that a ticket was printed by the primary content controller 263 for the combined credit total. The accounting control module 238 and the casino accounting system 290 can further communicate accounting coordination data 215. For example, the accounting control module 238 and the casino accounting system 290 can communicate certain SAS communications that the casino accounting system 290 would be expecting for the second cash-out mode, such as information for the printed ticket.

The wagering game system architecture 200 can also include an account server 270 configured to provide user information and store information related to a player account or a financial account associated with a player. In some embodiments, the secondary content controller 230 is configured to send a combined credit total to the account stored on the account server 270 instead of cashing out the combined credit total to an output device of the wagering game machine 260. For example, instead of printing a ticket via a printer of the wagering game machine 260, or instead of writing a credit amount to a card via a magnetic card reader of the wagering game machine 260, the accounting control module 238 may instead send adapted accounting data 220 from the secondary content controller 230 to the account server 270. The adapted accounting data 220 includes information necessary to electronically transfer the amount of the combined credit total to the account associated with the account server 270.

Furthermore, in some embodiments, the accounting control module 238 sends adapted accounting data 225 to the secondary wagering game server 280. For instance, because the secondary content controller 230 can function as a proxy, or spoof of the accounting host, the secondary content controller 230 may be required for various reasons (e.g., by jurisdictional rules) to track accounting data. Consequently, the accounting control module 238 sends information about accounting transactions to the secondary wagering game server 280. The secondary wagering game server 280 keeps a log of the transactions, such as a log of the AFT transactions. In some embodiments, the secondary wagering game server 280 can provide the log to other devices shown or not shown in FIG. 2.

Each component in the wagering game system architecture 200 is shown as a separate and distinct element. Some elements may be connected via a communications network 222 as shown in FIG. 2. In other examples, some, or all, of the components shown may all be contained in one device, or in different devices according to other configurations not shown in FIG. 2. For instance, the secondary content controller 230 and the casino accounting system 290 may be incorporated into the wagering game machine 260 as similarly described in FIG. 1. Furthermore, some functions performed by one component could be performed by other components. For example, the primary wagering game server 250 can also be configured to perform functions of the wagering game machine 260, and other network elements and/or system devices. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
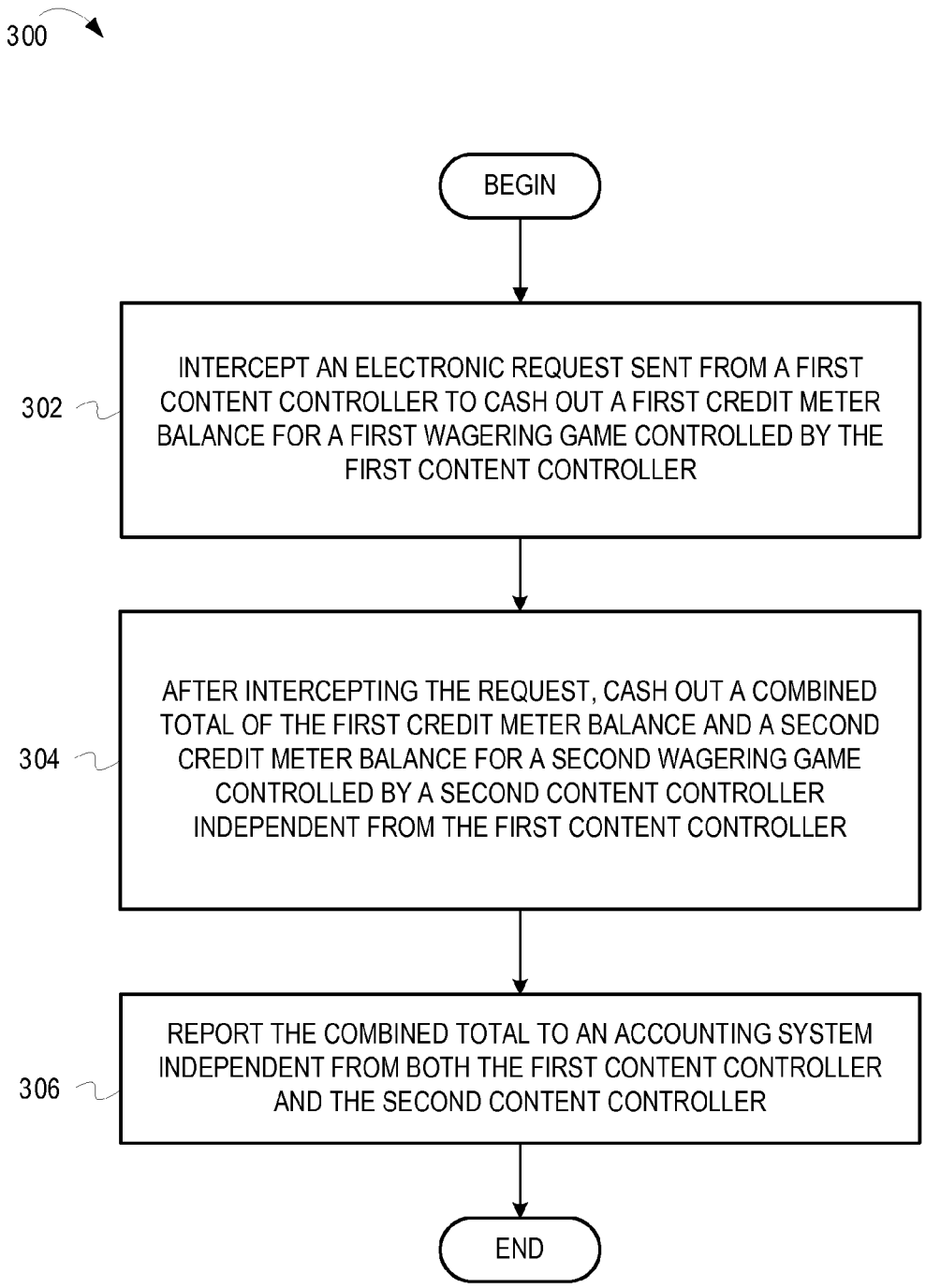
FIG. 3 is a flow diagram 300 illustrating cashing out multiple, independent wagering games, according to some embodiments.

FIG. 3 is a flow diagram ("flow") 300 illustrating cashing out multiple, independent wagering games, according to some embodiments. In FIG. 3, the flow 300 begins at processing block 302, where a wagering game system ("system") intercepts an electronic request sent from a first content controller to cash out a first credit meter balance for a first wagering game controlled by the first content controller. One example was described previously for FIG. 1 where the secondary content controller 130 intercepted a cash-out message sent from the primary content controller 163 for a cash-out request for the primary wagering game 102.

The flow 300 continues at processing block 304, where, after intercepting the request, the system cashes out a combined total of the first credit meter balance and a second credit meter balance for a second wagering game controlled by a second content controller independent from the first content controller. In some embodiments, the system combines all funds from the first wagering game and the second wagering game into the combined total. For instance, the system can initiate a first Advanced Funds Transfer (AFT) cycle to move the first game balance for the primary wagering game to the second content controller and combine the first game balance with the second game balance for the second wagering game, resulting in the combined total.

Furthermore, the system generates a cash out for the combined total via a cash-out mechanism of the wagering game machine. For instance, the system initiates a second AFT cycle to move the combined total from the second content controller back to the first content controller to cash out the combined total via the cash-out mechanism of the wagering game machine. In some embodiments, the system sends to the first content controller a cash-out request, such as a print-to-ticket request to print the funds to a redeemable ticket, a funds-to-account request to transfer funds to a player account or player card, or some other transaction to produce cash or a cash equivalent for the combined total.

In some instances, the first content controller instructs the wagering game machine to generate a physical cash-out object from a physical cash-out device of the wagering game machine. For example, the wagering game machine may have a cash dispenser to dispense an amount of cash equivalent to the combined total. In another example, the wagering game machine includes a device that generates a physical cash equivalent, such as a printer that generates a physical ticket or voucher with an identifier (e.g., coded identifier) that indicates the combined total.

In some examples, the first content controller initiates an electronic cash out from a physical output device of the wagering game machine. For example, the output device of the wagering game machine may be an electro-magnetic device or radio transmission device that sends an electronic signal to an object capable of reading the signal (e.g., a player card, a debit card, a credit card, etc.). The electronic signal specifies the combined total. The signal causes the combined total to be written to the object.

In some embodiments, the system cashes out the combined total to an account or a persistent electronic object. For instance, the system can cash out the combined total to a player account. In another example, the system can generate an electronic document or object, such as an electronic coupon, an electronic voucher, an electronic barcode (e.g., a 2D barcode), a digital text representation of an alphanumeric identifier, etc. The system can send the electronic document or object to an account or device associated with the player (e.g., send an email to the player, transmit a text message to a player's personal mobile device, store a credit balance in a player account, etc.).

In some embodiments, by concurrently cashing out both a primary game credit balance and a secondary game credit balance, a primary wagering game session for the primary wagering game and a secondary wagering game session for the secondary wagering game can terminate concurrently.

The flow 300 continues at processing block 306, where the system reports the combined total to an accounting system independent from both the first content controller and the second content controller. For example, the system sends to the accounting system a message that indicates the combined total. The message indicates information related to the way the combined total was cashed out. For example, if the cash out was to a ticket, the second content controller sends to the accounting system information related to an amount printed to a ticket, a verification number for the ticket, a data/time stamp, etc. If, on the other hand, the cash out was to an electronic device (e.g., a player card) or account (e.g., a player account or financial account), the system sends to the accounting system identifiers for the electronic transmissions. For example, the system identifiers can include an electronic identifier for an electronic transmission, an electronic funds transfer identifier, an account identifier, date/time information for when the electronic transmission was sent, encryption/decryption information, a certificate sent with the electronic transmission, etc.

FIGS. 4 and 5 illustrate a flow diagram ("flow") 400 illustrating cashing out multiple, independent wagering games, according to some embodiments. FIGS. 6A-6F are conceptual diagrams that helps illustrate the flow of FIGS. 4 and 5, according to some embodiments. This description will present FIGS. 4 and 5 in concert with FIGS. 6A-6F. The description of FIGS. 4-6 refers to some operations being performed by a wagering game machine. In some embodiments, the operations that are performed by the wagering game machine may be performed by a primary content controller that has been programmed and/or configured to work as a cohesive unit with a wagering game machine, such as the primary content controller 163 of FIG. 1 or the primary content controller 263 of FIG. 2. In some embodiments, some of the operations may be performed by one or other elements of a wagering game machine (e.g., a processor of the wagering game machine, an input device of the wagering game machine, an output device of the wagering game machine, etc.) separately from, or in connection with a primary content controller. Furthermore, the primary content controller may have hardware, software, firmware, or other components that are shared with some components of the wagering game machine in certain ways, or at certain times, differently than from other components of the wagering game machine. Therefore, to avoid having to distinguish whether the operations associated with the wagering game machine are performed by a primary content controller exclusively, in cooperation with the primary content controller, or by a different component of the wagering game machine, FIGS. 4-6 refer generally to the wagering game machine as performing the operations.

In FIG. 4, the flow 400 begins at processing block 402, where a wagering game machine detects that a cash-out button is selected on the wagering game machine. FIGS. 6A-6F illustrate how amounts of credits are transferred between the wagering game machine 160 and the secondary content controller 130. FIGS. 6A-6F also show amounts in the first credit meter 120 for the primary wagering game (see FIG. 1) and the second credit meter 137 for the secondary wagering game (see FIG. 1). FIGS. 6A-6F also show amounts in a memory 620 for the wagering game machine and in a memory 637 for the secondary content controller 130. Memory 620 and memory 637 may be ones of multiple possible locations in memory stored in one or more possible data storage devices or components associated with the wagering game machine 160 and the secondary content controller 130. For simplicity, however, instead of showing all possible configurations of memory for the wagering game machine 160 or the secondary content controller 130, only the memory 620 and the memory 637 are shown in FIGS. 6A-6F. For example, memory 620 and memory 637 may be separate random access memory (RAM) devices for the wagering game machine 160 and for the secondary content controller 130. It should further be noted that while data shown in the memory 620 and memory 637 may change, such as to a value of zero, the values that were previously stored in the memory 620 and memory 637 could be stored in other memory devices, such as data storage disks or non-volatile RAM for the wagering game machine 160 and/or the secondary content controller 130. FIGS. 6A-6F will be referred to repeatedly throughout the description of FIGS. 4 and 5.

Figure 6A:
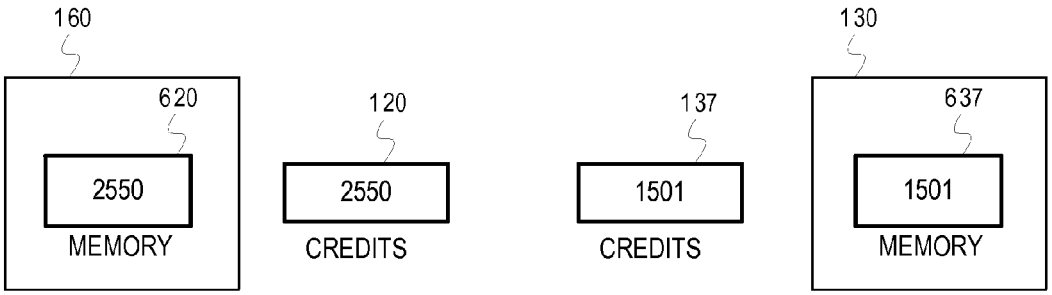

Referring to FIG. 6A, the first credit meter 120 for the primary wagering game reads a first amount of credits (i.e., "2550" credits). The memory 620 in the wagering game machine 160 stores the value of the first amount of credits. The first amount of credits includes credits that have been associated with the primary wagering game by winnings of the primary wagering game, by a cash deposit, by a transfer from a player account, by an electronic deposit through a financial or credit account, or some other way. The amount of credits indicated in the first credit meter 120 is referred to herein as a "primary game credit balance." The second credit meter 137 shows a second amount of credits (i.e., "1501" credits), which have been associated with the secondary wagering game as similarly described for the primary wagering game. Furthermore, some of the credits in the second credit meter 137 may have been previously transferred from the primary wagering game. The amount of credits indicated in the second credit meter 137 is referred to herein as a "secondary game credit balance." The memory 637 associated with the secondary content controller 130 shows the amount for the secondary game credit balance.

Returning to FIG. 4, the flow 400 continues at processing block 404, where the wagering game machine sends an indication that the cash-out button was selected. When a player selects the cash out button, the wagering game machine sends a first message that the cash out button has been selected (e.g., sends a "0x66" SAS message). This message is sent regardless of the amount of money or equivalent (e.g., credits) in the primary game credit balance, even if the amount is zero (0). The first message is a SAS message directed to an accounting host. For instance, in some embodiments, the message is placed in a queue associated with the accounting host. The accounting host is configured to read the messages from the queue in a first-in-first-out basis until the queue is empty. Therefore, in some embodiments that utilize a queue, when the wagering game machine sends a message to the secondary content controller, the wagering game machine places the message in the queue. When the secondary content controller receives the message, the secondary content controller reads the message in the queue and responds to the message as necessary.

The flow 400 continues at processing block 406, where the wagering game machine sends a request for cash-out to an accounting host. For example, the wagering game machine sends a request (e.g., "0x6A" SAS message) to begin the process of a first cash-out mode (e.g., a cash-out to an accounting host mode). The first cash-out mode involves using one or more Advanced Funds Transfer transactions between the wagering game machine and the accounting host for any amount of wagering game funds associated with the wagering game machine (e.g., the funds in the primary game credit balance).

The flow 400 continues at processing block 408, where a secondary content controller intercepts both the request for the cash-out to the accounting host and the indication that the cash-out button was selected. In some embodiments, the secondary content controller can intercept the first and second message by snooping a network communication that directed to the casino accounting system (i.e., detects that the first and second messages are directed to a network account for the casino accounting system) and blocks the messages from being transmitted to the casino accounting system. The secondary content controller can read the first and second SAS messages and respond to them in place of the casino accounting system. Similar operations occur in other instances where the secondary content controller intercepts a message from the wagering game machine. In other embodiments, however, the secondary content controller accesses a queue of messages associated with the accounting host and reads the messages from the queue before the casino accounting system reads the messages. The secondary content controller can also block the casino accounting system from reading the queue.

The flow 400 continues at processing block 410, where the secondary content controller sends to the casino accounting system the indication that the cash-out button was selected, but blocks the request for the cash out to the accounting host so that the casino accounting system does not receive it. The secondary content controller notifies the casino accounting system that the cash-out button was selected (e.g., it forwards the (0x66) SAS message). However, the secondary content controller does not send the request for the cash-out to the account host (i.e., does not send the (0x6A message)) because the secondary content controller will transact the cash-out process as the accounting host instead of the casino accounting system. By intercepting the SAS messages and acting in place of the casino accounting system, the secondary content controller can ensure that a cash out for any amount in a second game credit balance is transacted concurrently with a cash out for any amount of the first game credit balance. Thus, amounts for the second game credit balance (if any) for the balances of the wagering game sessions are cashed out to the same cash-out mechanism.

The flow 400 continues at processing block 412, where the casino accounting system detects the indication that the cash-out button was selected. In the flow 400, the casino accounting system receives information from the secondary content controller as if a second cash-out mode (e.g., a hard cash-out mode or cash-out to ticket mode) is enabled for the wagering game machine. In other words, the secondary content controller acts as a proxy for the wagering game machine as an accounting host, and the secondary content controller also sends messages to the casino accounting system as if the wagering game machine were functioning in a second cash-out mode.

The flow 400 continues at processing block 414, where the secondary content controller sends to the wagering game machine a command to transfer all funds from the wagering game machine to the secondary content controller. The secondary content controller sends a command (e.g., a "0x72, type 80" SAS message), which indicates to the wagering game machine to transfer all the funds that the wagering game has, such as the primary game credit balance. The command sent by the secondary content controller initiates a first transfer cycle.

Figure 6B:
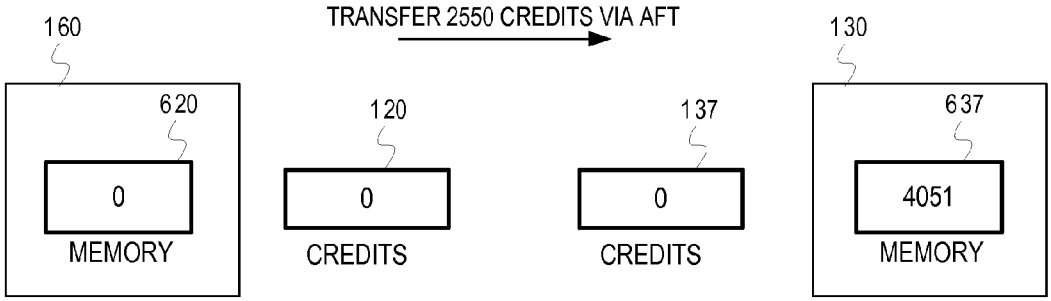
Figure 6C:
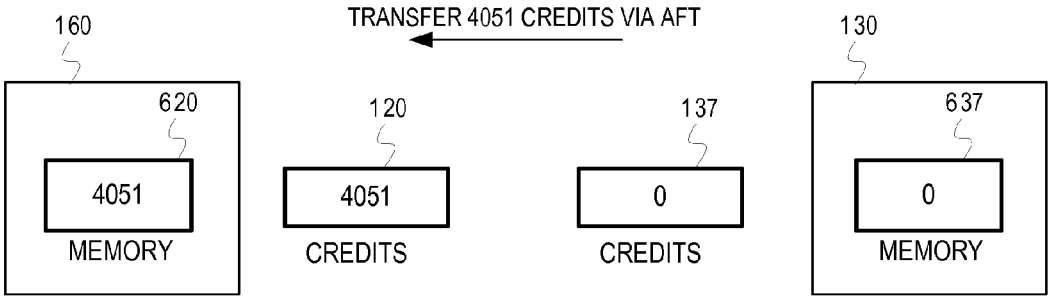

The flow 400 continues at processing block 416, where the wagering game machine transfers the primary game credit balance to the secondary content controller. The wagering game machine sends all funds (e.g., via a "0x72, type 80" SAS message) to the secondary content controller, such as via AFT. In other words, the wagering game machine sends the amount of the primary game credit balance to the secondary content controller. If the primary game credit balance is zero, the wagering game machine still sends an indication of a zero amount. Furthermore, in some embodiments, the wagering game machine may present more than one wagering game (e.g., a primary wagering game and a secondary wagering game, both from the same wagering game source). In such a case, the wagering game machine transfers all of the funds for all the wagering games running on the wagering game machine. In such a case, either (a) the primary content controller would consolidate the wagering game balances presented by the primary content controller into a main credit meter and transfer that consolidated amount or (b) each of the wagering games would sends a separate funds transfer, all of which are intercepted by the secondary content controller. Referring temporarily to FIG. 6B, the credit amount in the first credit meter 120 may briefly display a value of zero after funds from the wagering game machine are transferred to the secondary content controller 130.

Referring again to FIG. 4, the flow 400 continues at processing block 418, where the secondary content controller intercepts the transfer of the primary game credit balance and adds the primary game credit balance to a secondary game credit balance, which generates a combined credit total. For instance, the secondary content controller receives the message sent by the wagering game machine at processing block 416 and adds any amount of funds sent by the wagering game machine to a secondary game credit balance. In the example shown in FIG. 6B, the secondary content controller stores the value of the primary game credit balance (i.e., the "2550" credits) in memory 637 and adds to that value the secondary game credit balance (i.e., the "1501" credits), thus resulting in a value of "4051" credits. The memory 637 stores the combined total of the credits. The amount of credits in the secondary game credit meter 137 shows as zero, as does the amount of credits shown in the primary game credit meter 120. In other embodiments, the secondary game credit meter 137 could indicate briefly the value of the combined total. However, for simplicity, the secondary game credit meter 137 shows as zero in the embodiment shown in FIG. 6B. Furthermore, in some embodiments, there may be multiple secondary wagering games presented on a display at once, each with its own credit meter. Therefore, to avoid having to add values to one, or all, of the credit meters, all of the values from those credit meters would be added to the amount of credits transferred from the wagering game machine 160 and stored in the memory 637. All of the secondary game credit meters would then show a value of zero.

The flow 400 continues at processing block 420, where the secondary content controller sends an indication of no activity to the casino accounting system. For instance, the secondary content controller sends to the casino accounting system a message that no activity is occurring (e.g., sends a "0x00" SAS message). The casino accounting system is constantly running a polling cycle and is expecting additional information after the cash-out button was selected. Therefore, the secondary content controller sends the message that indicates no activity is occurring.

The flow 400 continues at processing block 422, where the casino accounting system detects the indication of no activity sent from the secondary content controller. As mentioned before, the casino accounting system is expecting certain information for the second type of cash-out mode (e.g., the hard cash-out mode or cash-out to ticket mode). The indication of no activity is a message that the casino accounting system expects to receive (e.g., during the period when the wagering game machine would be printing a ticket for a hard cash-out procedure). Because the casino accounting system acts as a host accounting system to the secondary content controller (i.e., for the hard cash-out mode), the casino accounting system may also utilize a queue for communications with the secondary content controller which the casino accounting system controls. After receiving the message that the cash-out button was pressed at processing block 412, the casino accounting system polls for additional data messages about the hard cash out process from the secondary content controller so that the messages can be read from the queue. If the casino accounting system does not receive a response to its polling, the casino accounting system would consider communications with the secondary content controller to be out of synchronization, which may cause the casino accounting system to perform unnecessary measures to restore synchronization and reinitiate its polling process. Therefore, while the secondary content controller is engaged in communicating with the wagering game machine (which may take more time to perform the cash-out to host procedure than to perform a hard cash-out procedure), to satisfy the polling by the casino accounting system, the secondary content controller sends the indication of no activity at processing block 420. Thus, at processing block 422, the casino accounting host's polling is satisfied.

The flow 400 continues at processing block 424, where the wagering game machine sends a message that the wagering game machine has completed its portion of the first transfer cycle. Following the message sent at processing block 416, the wagering game machine sends an additional message (e.g., a "0x69" SAS message) indicating that the AFT transfer of the funds was completed by the wagering game machine.

The flow 400 continues at processing block 426, where the wagering game machine determines whether a response message is sent that verifies the completion of the first transfer cycle. The wagering game machine continues to send the message at processing block 424 until receiving a response that indicates that the transfer was received by the accounting host (for which the secondary content controller stands in as proxy) and that a first portion of the cash-out to host (i.e., the transfer cycle of the funds from the wagering game machine) is complete.

The flow 400 continues at processing block 428, where the secondary content controller sends a message that the transfer of funds was received and that the first funds transfer cycle is completed. For instance, the secondary content controller sends a message (e.g., a "0x72" SAS message) to notify the wagering game machine that the transfer of the funds was received and that the first transfer cycle was completed. The message indicates to the wagering game machine to stop sending the message at processing block 424.

When the wagering game machine receives this message, the flow 400 from processing block 426 can continue to processing block 430 shown in FIG. 5.

Referring to FIG. 5, the flow 400 from processing block 428 continues at processing block 429, where the secondary content controller sends a command to the wagering game machine to print the combined total to a ticket. For instance, the secondary content controller sends an AFT message (e.g., "0x72, type 20" SAS message) to the wagering game machine, which indicates to transfer the total amount for the combined total directly to a ticket. This initiates a second transfer cycle. The second transfer cycle also involves the printing of a ticket. Therefore, herein the second transfer cycle is referred to as a "print" cycle. The AFT message transfers the combined total of credits to the wagering game machine to print to the ticket. For example, in FIG. 6C, the secondary content controller 130 transfers the "4051" credits to the wagering game machine 160. The wagering game machine 160 stores the "4051" credit value in the memory 620. In some embodiments, the primary game credit meter 120 can temporarily show a value for the combined total (i.e., "4051" credits). In other embodiments, however, the primary game credit meter 120 may instead continue to show a value of zero credits. In some embodiments, where there are multiple wagering games presented, and controlled by, the wagering game machine 160 (other than the independent secondary game(s) controlled by the secondary content controller 130), when the total combined amount is transferred from the secondary content controller 130 to the wagering game machine 160, the wagering game machine 160 could show zero on all credit meters for the wagering games presented and controlled by the wagering game machine 160, yet store the combined total in the memory 620.

Referring again to FIG. 5, the flow 400 continues at processing block 430, where the wagering game machine indicates a receipt of the command to print the combined total to the ticket. For instance, the wagering game machine receives the message sent at processing block 429 (e.g., the "0x72, type 20" SAS message) and sends a response message (e.g., a "0x72" SAS message) to indicate that the transfer of the credits was received.

Figure 6D:
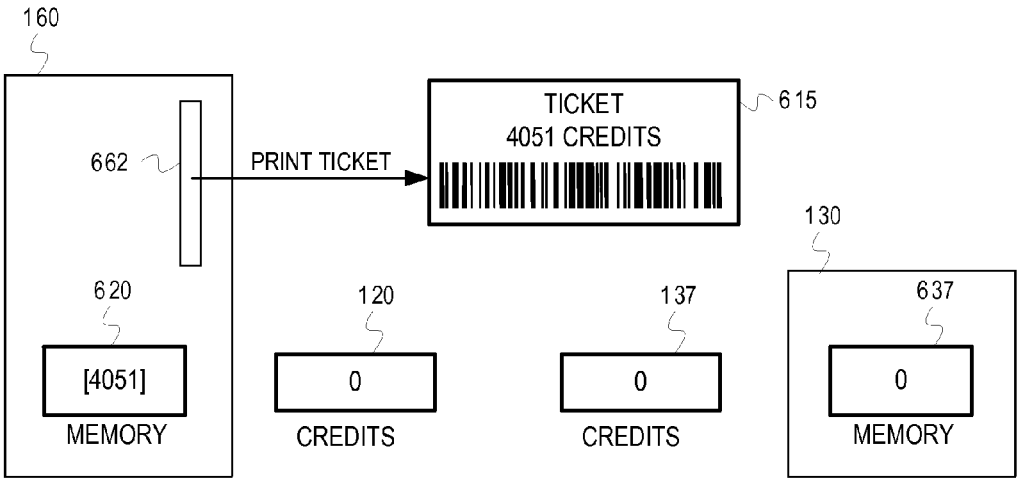

The flow 400 continues at processing block 432, where the wagering game machine prints the ticket for the combined total and sends a message that the ticket is printed. For instance, after receiving the combined total, the wagering game machine prints a ticket for the combined total. The ticket indicates the combined total and serves as a cash equivalent for the combined total. A player can take the ticket to a casino teller to convert to cash. The wagering game machine then sends a message (e.g., a "0x3D" SAS message) to the secondary content controller that the ticket was printed at the wagering game machine. In FIG. 6D, for instance, the wagering game machine 160 prints a ticket 615, from a ticket printer 662, for the value of the combined total of the "4051" credits. The primary game credit meter 120 and the secondary game credit meter 137 both show a value of zero. Further, the memory 637 indicates a value of zero. The memory 620 now holds information related to the printed ticket, such as credit value of the ticket, a ticket verification number, a data and time stamp for when the ticket was printed, and any other identifier or relevant information related to the ticket. The wagering game machine 160 then sends the "0x3D" SAS message to the secondary content controller 130 that the ticket 651 was printed at the wagering game machine 160.

Returning to FIG. 5, the flow 400 continues at processing block 434, where the secondary content controller intercepts the messages sent from the wagering game machine about the combined total and the printed ticket. The secondary content controller then sends to the casino accounting system a message that the ticket was printed. For instance, the secondary content controller intercepts the 0x3D SAS message sent from the wagering game machine and forwards the message to the casino accounting system.

The flow 400 continues at processing block 436, where the casino accounting system receives the message that ticket was printed. The casino accounting system then sends a request for ticket information (e.g., a "0x4D" SAS message). The casino accounting system requires the ticket information to store in a ticket database.

The flow 400 continues at processing block 438, where the secondary content controller intercepts and forwards the request by the casino accounting system for the ticket information. For instance, the secondary content controller receives the "0x4D" SAS message and forwards it to the wagering game machine.

Figure 6E:
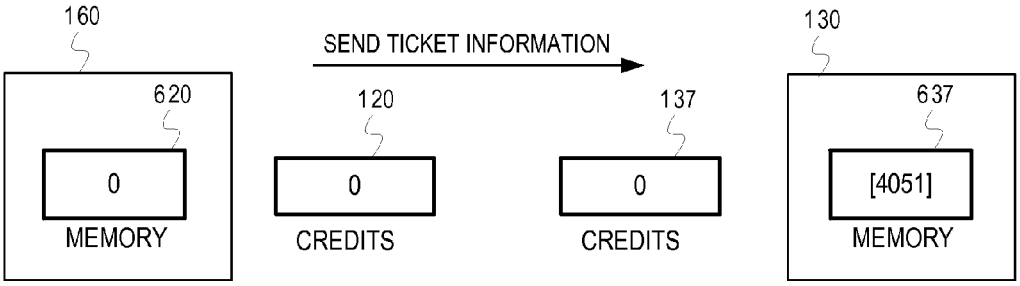

The flow 400 continues at processing block 440, where the wagering game machine receives the request for the ticket information and then sends the ticket information. For instance, the wagering game machine receives the "0x4D" SAS message and responds with ticket information (e.g., sends a response "0x4D" SAS message with the ticket information). For example, as shown in FIG. 6E, the wagering game machine 160 sends the ticket information to the secondary content controller 130. In some embodiments, the memory 620 for the wagering game machine 160 may be cleared or transferred to another memory location associated with the wagering game machine 160, such as to a persistent memory file or device used for regulatory purposes (e.g. to a NV-RAM which stores information about a past number of game plays or financial transactions) or to a data storage device on a different device (e.g., to a wagering game server). In one embodiment, as shown in FIG. 6E, the secondary content controller 130 reads the ticket information and stores it in the memory 637.

Figure 6F:
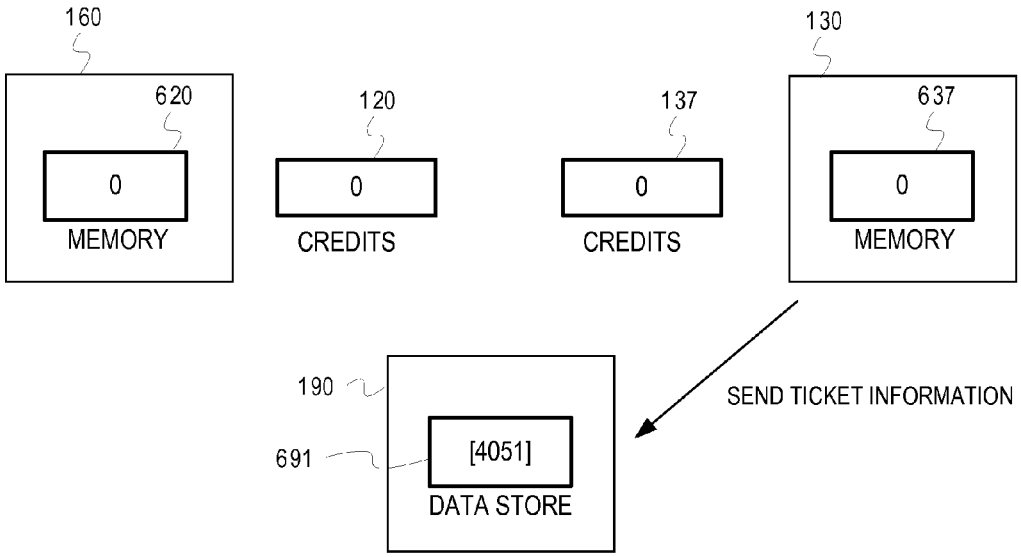

Referring back to FIG. 5, the flow 400 continues at processing block 442, where the secondary content controller intercepts the ticket information and forwards the ticket information to the casino accounting system. For instance, the secondary content controller intercepts the response "0x4D" SAS message sent at processing block 440, and forwards the information to the casino accounting system. In some embodiments, as shown in FIG. 6E, the secondary content controller 130 stores the ticket data in memory 637 (e.g., stores the value of the combined total printed on the ticket as well as other ticket information). Then, as shown in FIG. 6F, the secondary content controller 130 transfers the ticket information to the casino accounting system 190. In some embodiments, the secondary controller 130 generates a new "0x4D" SAS message which includes the same ticket information sent by the wagering game machine 160, which is now in the memory 637. The secondary content controller 130 then sends the new "0x4D" SAS message to the casino accounting system 190. In another embodiment, the secondary content controller 130 does not generate a new "0x4D" SAS message, but instead forwards the "0x4D" SAS message sent from the wagering game machine 160 to a network address associated with the casino accounting system 190.

Returning to FIG. 5, the flow 400 continues at processing block 444, where the casino accounting system detects the ticket information and updates a ticket database with the ticket information. For instance, the casino accounting system receives the "0x4D" SAS message (e.g., which originated from the wagering game machine and which was sent by the secondary content controller at processing block 442). Upon receipt of the "0x4D" SAS message, the casino accounting system populates the ticket database with the ticket information. For example, in FIG. 6F, when the casino accounting system 190 receives the ticket information, the casino accounting system 190 stores the ticket information in a data store 691 (e.g. a ticket database) associated with the casino accounting system 190.

Referring again to FIG. 5, the flow 400 continues at processing block 446, where the wagering game machine sends a message that the wagering game machine has completed its portion of the print cycle. For instance the wagering game machine sends a "0x69" SAS message.

The flow 400 continues at processing block 447, where the wagering game machine determines whether it has received verification that the print cycle is completed by the secondary content controller. For example, the wagering game machine will continue to send the "0x69" SAS message until it receives acknowledgement that it was received by the accounting host and that the print cycle can be completed.

The flow 400 continues at processing block 448, where the secondary content controller indicates that the print cycle is complete. For example, the secondary content controller sends a "0x72" SAS message to indicate that the transfer of information is complete and that the wagering game machine can stop sending the "0x69" SAS message from processing block 446. The print cycle ends and the portion of the flow 400 performed by the wagering game machine ends.

The flow 400 continues at processing block 450, where the secondary content controller sends an indication of no activity to the casino accounting system. For instance, the secondary content controller sends another message to the casino accounting system that there is no additional activity (e.g., sends a "0x00" SAS message). The portion of the flow 400 performed by the secondary content controller ends.

The flow 400 continues at processing block 452, where the casino accounting system detects the no activity signal sent from the secondary content controller. The portion of the flow 400 performed by the casino accounting system ends.

Additional Example Operating Environments

This section describes additional example operating environments, systems, networks, etc. and presents structural aspects of some embodiments.

Wagering Game System Architecture

FIG. 7 is a conceptual diagram that illustrates an example of a wagering game system architecture 700, according to some embodiments. The wagering game system architecture 700 includes an account server 770 configured to control user related accounts accessible via wagering game networks and social networks. The account server 770 can store and track player information, such as identifying information (e.g., avatars, screen name, account identification numbers, etc.) or other information like financial account information, social contact information, etc. The account server 770 can contain accounts for social contacts referenced by the player account. The account server 770 can also provide auditing capabilities, according to regulatory rules, and track the performance of players, machines, and servers.

The wagering game system architecture 700 also includes a wagering game server 750 configured to control wagering game content, provide random numbers, and communicate wagering game information, account information, and other information to and from a wagering game machine 760. The wagering game server 750 includes a content controller 751 configured to manage and control content for presentation on the wagering game machine 760. For example, the content controller 751 can generate game results (e.g., win/loss values), including win amounts, for games played on the wagering game machine 760. The content controller 751 can communicate the game results to the wagering game machine 760. The content controller 751 can also generate random numbers and provide them to the wagering game machine 760 so that the wagering game machine 760 can generate game results. The wagering game server 750 can also include a content store 752 configured to contain content to present on the wagering game machine 760. The wagering game server 750 can also include an account manager 753 configured to control information related to player accounts. For example, the account manager 753 can communicate wager amounts, game results amounts (e.g., win amounts), bonus game amounts, etc., to the account server 770. The wagering game server 750 can also include a communication unit 754 configured to communicate information to the wagering game machine 760 and to communicate with other systems, devices and networks. The wagering game server 750 can also include a Slot Accounting System (SAS) module 755 configured to communicate with one or more elements of the wagering game system architecture 700 regarding one or more types of cash out modes that use the Slot Accounting System protocol.

The wagering game system architecture 700 also includes the wagering game machine 760 configured to present a primary wagering game and a secondary wagering game. The wagering game machine 760 includes a processing unit 762 configured to manage and control content and presentation of content on the wagering game machine 760. The wagering game machine 760 also includes a memory 763 configured to contain content to present on the wagering game machine 760. The memory 763 includes primary game content 764 for presentation of a primary wagering game on the wagering game machine 760. The memory 763 also includes secondary game content 765 for presentation of a secondary wagering game on the wagering game machine 760. The wagering game machine 760 can also include a SAS module 767 configured to communicate with one or more elements of the wagering game system architecture 700 regarding one or more cash out modes that use the Slot Accounting System protocol. The wagering game machine 760 can also include an input/output controller 768 configured to detect input and provide output for the wagering game machine 760.

The wagering game system architecture 700 also includes a secondary game server 780 configured to provide and/or control secondary game content. The secondary game server 780 can include a processor 781 configured to control operations of the secondary game server 780. The secondary game server 780 also includes a secondary game content store 782 configured to store secondary game content. The secondary game server 780 also includes a secondary content controller 783 configured to present independent secondary game content via the wagering game machine 760 and cash out the secondary game and the primary game concurrently.

Each component shown in the wagering game system architecture 700 is shown as a separate and distinct element connected via a communications network 722. However, some functions performed by one component could be performed by other components. For example, the wagering game server 750 can also be configured to perform functions of the wagering game machine 760, and other network elements and/or system devices. In other examples, the secondary content controller 783 shares or distributes operations with the SAS module 755 and/or the SAS module 767. Furthermore, the components shown may all be contained in one device, but some, or all, may be included in, or performed by, multiple devices, as in the configurations shown in FIG. 7 or other configurations not shown. For example, in some embodiments, the wagering game machine 760 can determine wagering game outcomes, generate random numbers, etc. instead of, or in addition to, the wagering game server 750.

The wagering game machines described herein (e.g., wagering game machine 760) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 700 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+ frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems 804 (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a secondary content controller 837. The secondary content controller 837 can process communications, commands, or other information, where the processing can concurrently cash out independent wagering games.

Furthermore, any component of the wagering game machine 806 can include hardware, firmware, and/or machine-readable storage media including instructions for performing the operations described herein.

Wagering Game System

FIG. 9 is a conceptual diagram that illustrates an example of a wagering game system 900, according to some embodiments. In FIG. 9, the wagering game system 900 includes a wagering game machine 960 similar to those used in gaming establishments, such as casinos. The wagering game machine 960 may, in some examples, be referred to as a gaming terminal or an electronic gaming machine. The wagering game machine 960 may have varying structures and methods of operation. For example, the wagering game machine 960 may include electromechanical components configured to play mechanical slots. In another example, the 960 includes electronic components configured to play a video casino game, such as slots, keno, poker, blackjack, roulette, craps, etc. The wagering game machine 960 is depicted as a floor-standing model. However, other examples of wagering game machines include handheld mobile units, bartop models, workstation-type console models, etc. Further, the wagering game machine 960 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 960 illustrated in FIG. 9 comprises a cabinet 911 that may house various input devices, output devices, and input/output devices. By way of example, the wagering game machine 960 includes a primary display area 912, a secondary display area 914, and one or more audio speakers 916. The primary display area 912 or the secondary display area 914 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 912 or the secondary display area 914 includes mechanical reels to display a wagering game outcome. In some example, the primary display area 912 or the secondary display area 914 present a transmissive video display disposed in front of a mechanical-reel display to portray a video image superimposed upon the mechanical-reel display. In FIG. 9, the wagering game machine 960 is a "slant-top" version in which the primary display 912 is slanted (e.g., at about a thirty-degree angle toward the player of the wagering game machine 960). Another example of wagering game machine 960 is an "upright" version in which the primary display 914 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 960. The wagering game machine 960 includes a touch screen(s) 918 mounted over the primary or secondary areas, buttons 920 on a button panel, bill validator 922, information reader/writer(s) 924, and player-accessible port(s) 926 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 918, buttons 920, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form (e.g., software, processing application) readable by a machine (e.g., a computer). For example, machine-readable storage media includes magnetic storage medium (e.g., floppy diskette), read only memory (ROM), random access memory (RAM), magnetic disk storage media, optical storage media (e.g., CD-ROM), magneto-optical storage media, flash memory, erasable programmable memory (e.g., EPROM and EEPROM), or other types of media suitable for storing electronic instructions. In addition, embodiments may be embodied in a machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method for facilitating electronic cooperation between a first content control device and a second content control device in an electronic wagering game system, the method comprising:

intercepting, by the second content control device, first video content for a first wagering game, the first video content originating from the first video content control device and destined for a video display device of the electronic wagering game system;

causing, by the second content control device, presentation of second video content for a second casino wagering game integrated with the first video content for the first wagering game on the video display device;

intercepting, via a communications interface of the first content control device, an electronic request, sent from the second content control device, to cash out a second credit meter balance for the second casino wagering game; and after intercepting the electronic request, cashing out, by an accounting control module of the first content control device, a combined total of the second credit meter balance and a first credit meter balance for the first casino wagering game.

2. The method of claim 1, wherein the intercepting the electronic request comprises preventing the electronic request from being sent from the second content control device to an accounting system independent from the second content control device and the first content control device.

3. The method of claim 1 further comprising:

reporting the combined total to an accounting system independent from both the second content control device and the first content control device.

4. The method of claim 3, wherein the second content control device is configured to cash out the second credit meter balance with the accounting system in a first cash-out mode that requires a funds transfer from the second content control device to the accounting system, wherein the cashing out the combined total comprises cashing out the second casino wagering game and the first casino wagering game in the first cash-out mode as a proxy for the accounting system, and wherein the reporting the combined total to the accounting system comprises reporting the combined total to the accounting system in a second cash-out mode that does not require the funds transfer from the second content control device.

5. The method of claim 3, wherein the electronic request is made using a Slot Accounting System protocol and wherein the accounting system comprises a Slot Accounting System server.

6. The method of claim 1, wherein the cashing out the combined total of the second credit meter balance and the first credit meter balance comprises:

combining, into the combined total, the second credit meter balance and the first credit meter balance; and sending a command to the second content control device to generate a cash-out object for the combined total via a single cash-out mechanism.

7. The method of claim 6, wherein the combining the second credit meter balance and the first credit meter balance includes a first funds transfer that transfers the second credit meter balance from the second content control device to the first content control device, and wherein the generating the cash-out object for the combined total includes a second funds transfer that transfers the combined total to the second content control device to generate the cash-out object.

8. The method of claim 6, wherein the cash-out object comprises one or more of an amount of cash equivalent to the combined total, a printed cash equivalent that indicates a value for the combined total, and a persistent electronic object that indicates a value for the combined total.

9. The method of claim 1, wherein first wagering game content for the first casino wagering game is provided by a first wagering game source, and wherein second wagering game content for the second casino wagering game is provided by a second wagering game source different from the first wagering game source.

10. One or more machine-readable storage media having instructions stored thereon, which when executed by a set of one or more processors of a first content control device cause the set of one or more processors to perform operations for facilitating electronic cooperation between a first content control device and a second content control device in an electronic wagering game system, the instructions comprising:

instructions to control a first casino wagering game having a first credit meter balance;

instructions to intercept, via a communications interface of the first content control device, an electronic request sent from a second content control device to cash out a second credit meter balance for a second casino wagering game controlled by the second content control device, wherein the first content control device is independent from the second content control device; and instructions to after interception of the electronic request, cash out a combined total of the second credit meter balance and the first credit meter balance.

11. The one or more machine-readable storage media of claim 10, wherein the operations for intercepting the electronic request include operations comprising preventing the electronic request from being sent from the second content control device to an accounting system independent from the second content control device and the first content control device.

12. The one or more machine-readable storage media of claim 10, said operations further comprising:

reporting the combined total to an accounting system independent from both the second content control device and the first content control device.

13. The one or more machine-readable storage media of claim 12, wherein the second content control device is configured to cash out the second credit meter balance with the accounting system in a first cash-out mode that requires a funds transfer from the second content control device to the accounting system, wherein the cashing out the combined total comprises cashing out the second casino wagering game and the first casino wagering game in the first cash-out mode as a proxy for the accounting system, and wherein the reporting the combined total to the accounting system comprises reporting the combined total to the accounting system in a second cash-out mode that does not require the funds transfer from the second content control device.

14. The one or more machine-readable storage media of claim 12, wherein the electronic request is made using a Slot Accounting System protocol and wherein the accounting system comprises a Slot-Accounting-System server.

15. The one or more machine-readable storage media of claim 10, wherein the operation of cashing out the combined total of the second credit meter balance and the first credit meter balance includes operations comprising:

combining, into the combined total, the second credit meter balance and the first credit meter balance; and sending a command to the second content control device to generate a cash-out object for the combined total via a single cash-out mechanism.

16. A gaming system comprising:

at least one processor;

at least one network communications interface configured to connect a first content control device with a second content control device independent from the first content control device, wherein the first content control device is associated with a first casino wagering game having a first credit meter balance, and wherein the second content control device is associated with a second casino wagering game having a second credit meter balance; and at least one memory device configured to store instructions which, when executed by the at least one processor, cause the gaming system to facilitate electronic cooperation between a first content control device and a second content control device, the instructions including instructions to intercept an electronic request sent from the second content control device to cash out the second credit meter balance, and instructions to after the electronic request is intercepted, cash out a combined total of the second credit meter balance and the first credit meter balance.

17. The gaming system of claim 16, the instructions further including:

instructions to combine, into the combined total, the second credit meter balance and the first credit meter balance; and instructions to send a command to the second content control device to generate a cash-out object for the combined total via a single cash-out mechanism.

18. The gaming system of claim 17 wherein the instructions further including:

instructions to transfer first funds from the second credit meter balance to the first content control device, and instructions transfer second funds for the combined total to the second content control device to generate the cash-out object.

19. The gaming system of claim 17, wherein the cash-out object comprises one or more of an amount of cash equivalent to the combined total, a printed cash equivalent that indicates a value for the combined total, and a persistent electronic object that indicates a value for the combined total.

20. The gaming system of claim 16, wherein first wagering game content for the first casino wagering game is provided by a first wagering game source, and wherein second wagering game content for the second casino wagering game is provided by a second wagering game source different from the first wagering game source.

* * * * *